US008911290B2

(12) United States Patent
Brosnan et al.

(10) Patent No.: US 8,911,290 B2
(45) **Date of Patent: *Dec. 16, 2014**

(54) GAMING SYSTEM, GAMING DEVICE, AND METHOD CHANGING AWARDS AVAILABLE TO BE WON IN PENDING PLAYS OF A GAME BASED ON A QUANTITY OF CONCURRENTLY PENDING PLAYS OF THE GAME

(71) Applicant: IGT, Las Vegas, NV (US)

(72) Inventors: William R. Brosnan, Reno, NV (US); Dwayne R. Nelson, Las Vegas, NV (US); Andrew P. Kertesz, Henderson, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/024,279

(22) Filed: Sep. 11, 2013

(65) Prior Publication Data

US 2014/0011559 A1 Jan. 9, 2014

Related U.S. Application Data

(63) Continuation of application No. 13/240,478, filed on Sep. 22, 2011, now Pat. No. 8,545,312.

(51) Int. Cl.
*A63F 9/24* (2006.01)

(52) U.S. Cl.
USPC ..... 463/20; 463/16; 463/25; 463/29

(58) Field of Classification Search
USPC ..... 463/16, 20, 25
IPC ..... G07F 17/32
See application file for complete search history.

(56) References Cited

U.S. PATENT DOCUMENTS

| | | | |
|---|---|---|---|
| 4,072,930 | A | 2/1978 | Lucero et al. |
| 4,448,419 | A | 5/1984 | Telnaes |
| 4,467,424 | A | 8/1984 | Hedges et al. |
| 4,621,814 | A | 11/1986 | Stepan et al. |
| 4,669,731 | A | 6/1987 | Clarke |
| 4,679,143 | A | 7/1987 | Hagiwara |

(Continued)

FOREIGN PATENT DOCUMENTS

| | | |
|---|---|---|
| AU | 524709 | 9/1982 |
| AU | 589158 | 10/1989 |

(Continued)

*Primary Examiner* — Omkar Deodhar
(74) *Attorney, Agent, or Firm* — Neal, Gerber & Eisenberg LLP

(57) ABSTRACT

Gaming systems, devices, and methods configured to change winnable awards of a pending play of a game based on a quantity of concurrently pending plays of the game are provided. The gaming system enables a player to sequentially initiate multiple plays of a game such that a plurality of plays are concurrently pending. Each play of the game includes one or more awards available to be won in that play. When a quantity of concurrently pending plays of the game is greater than or equal to a designated quantity of plays of the game, the gaming system changes one or more of the awards available to be won in one or more of those concurrently pending plays of the game, and they remain changed as long as the quantity of concurrently pending plays of the game is greater than or equal to the designated quantity of plays of the game.

20 Claims, 14 Drawing Sheets

(56) References Cited

U.S. PATENT DOCUMENTS 4,695,053 A 9/1987 Vazquez, Jr. et al.
4,805,907 A 2/1989 Hagiwara
4,817,951 A 4/1989 Crouch et al.
4,837,728 A 6/1989 Barrie et al.
4,838,552 A 6/1989 Hagiwara
4,842,278 A 6/1989 Markowicz
4,844,464 A 7/1989 Berge
4,856,787 A 8/1989 Itkis
4,871,171 A 10/1989 Rivero
4,874,173 A 10/1989 Kishishita
4,926,327 A 5/1990 Sidley
4,991,848 A 2/1991 Greenwood et al.
5,048,833 A 9/1991 Lamle
5,092,598 A 3/1992 Kamille
5,116,055 A 5/1992 Tracy
5,123,649 A 6/1992 Tiberio
5,127,651 A 7/1992 Okada
5,152,529 A 10/1992 Okada
5,159,549 A 10/1992 Hallman, Jr. et al.
5,178,390 A 1/1993 Okada
5,179,517 A 1/1993 Sarbin et al.
5,209,476 A 5/1993 Eiba
5,249,800 A 10/1993 Hilgendorf et al.
5,259,613 A 11/1993 Marnell, II
5,275,400 A 1/1994 Weingardt
5,277,424 A 1/1994 Wilms
5,280,909 A 1/1994 Tracy
5,286,023 A 2/1994 Wood
5,292,127 A 3/1994 Kelly et al.
5,324,035 A 6/1994 Morris et al.
5,342,047 A 8/1994 Heidel et al.
5,342,049 A 8/1994 Wichinsky et al.
5,344,144 A 9/1994 Canon
5,370,399 A 12/1994 Liverance
5,371,345 A 12/1994 LeStrange et al.
5,377,973 A 1/1995 Jones et al.
5,390,934 A 2/1995 Grassa
5,393,061 A 2/1995 Manship et al.
5,395,111 A 3/1995 Inoue
5,395,242 A 3/1995 Slye et al.
5,397,128 A 3/1995 Hesse et al.
5,398,938 A 3/1995 Money
5,411,258 A 5/1995 Wilson et al.
5,417,430 A 5/1995 Breeding
5,450,938 A 9/1995 Rademacher
5,456,465 A 10/1995 Durham
5,470,079 A 11/1995 LeStrange et al.
5,472,194 A 12/1995 Breeding et al.
5,476,259 A 12/1995 Weingardt
5,489,101 A 2/1996 Moody
5,511,781 A 4/1996 Wood
5,531,441 A 7/1996 Dabrowski et al.
5,536,016 A 7/1996 Thompson
5,544,893 A 8/1996 Jones et al.
5,547,192 A 8/1996 Ishibashi
5,560,603 A 10/1996 Seelig et al.
5,564,700 A 10/1996 Celona
5,569,084 A 10/1996 Nicastro et al.
5,570,885 A 11/1996 Ornstein
5,580,309 A 12/1996 Piechowiak et al.
5,584,485 A 12/1996 Jone et al.
5,584,763 A 12/1996 Kelly et al.
5,584,764 A 12/1996 Inoue
5,593,349 A 1/1997 Miguel et al.
5,603,502 A 2/1997 Nakagawa
5,609,524 A 3/1997 Inoue
5,611,730 A 3/1997 Weiss
5,626,341 A 5/1997 Jones
5,639,088 A 6/1997 Schneider et al.
5,645,486 A 7/1997 Nagao et al.
5,655,961 A 8/1997 Acres et al.
5,664,998 A 9/1997 Seelig et al.
5,674,128 A 10/1997 Holch et al.
5,697,843 A 12/1997 Manship et al.
5,702,304 A 12/1997 Acres et al.
5,704,835 A 1/1998 Dietz, II
5,707,286 A 1/1998 Carlson
5,722,891 A 3/1998 Inoue
5,741,183 A 4/1998 Acres et al.
5,743,523 A 4/1998 Kelly et al.
5,743,800 A 4/1998 Huard et al.
5,752,882 A 5/1998 Acres et al.
5,758,875 A 6/1998 Giacalone, Jr.
5,761,647 A 6/1998 Boushy
5,762,552 A 6/1998 Vuong
5,766,076 A 6/1998 Pease et al.
5,770,533 A 6/1998 Franchi
5,775,692 A 7/1998 Watts et al.
5,779,545 A 7/1998 Berg et al.
5,779,547 A 7/1998 SoRelle et al.
5,779,549 A 7/1998 Walker et al.
5,816,915 A 10/1998 Kadlik
5,816,918 A 10/1998 Kelly et al.
5,820,459 A 10/1998 Acres et al.
5,833,537 A 11/1998 Barrie
5,836,817 A 11/1998 Acres et al.
5,851,011 A 12/1998 Lott
5,851,149 A 12/1998 Xidos et al.
5,855,514 A 1/1999 Kamille
5,855,515 A 1/1999 Pease et al.
5,876,284 A 3/1999 Acres et al.
5,885,158 A 3/1999 Torango et al.
5,890,962 A 4/1999 Takemoto
5,941,773 A 8/1999 Harlick
5,944,606 A 8/1999 Gerow
5,947,820 A 9/1999 Morro et al.
5,951,011 A 9/1999 Potter et al.
5,951,397 A 9/1999 Dickinson
5,967,894 A 10/1999 Kinoshita et al.
5,967,896 A 10/1999 Jorach et al.
5,976,015 A 11/1999 Seelig et al.
5,980,384 A 11/1999 Barrie
5,984,779 A 11/1999 Bridgeman et al.
5,984,782 A 11/1999 Inoue
5,989,121 A 11/1999 Sakamoto
5,993,316 A 11/1999 Coyle et al.
5,997,400 A 12/1999 Seelig et al.
6,001,016 A 12/1999 Walker et al.
6,004,207 A 12/1999 Wilson, Jr. et al.
6,007,427 A 12/1999 Wiener
6,012,982 A 1/2000 Piechowiak et al.
6,019,369 A 2/2000 Nakagawa et al.
6,024,642 A 2/2000 Stupak
6,033,307 A 3/2000 Vancura
6,039,648 A 3/2000 Guinn et al.
6,047,963 A 4/2000 Pierce et al.
6,048,271 A 4/2000 Barcelou
6,056,642 A 5/2000 Bennett
6,062,980 A 5/2000 Luciano
6,062,981 A 5/2000 Luciano, Jr.
6,068,552 A 5/2000 Walker et al.
6,068,553 A 5/2000 Parker
6,077,162 A 6/2000 Weiss
6,080,062 A 6/2000 Olson
6,089,977 A 7/2000 Bennett
6,089,980 A 7/2000 Gauselmann
6,102,400 A 8/2000 Scott et al.
6,110,041 A 8/2000 Walker et al.
6,110,043 A 8/2000 Olsen
6,120,376 A 9/2000 Cherry
6,126,542 A 10/2000 Fier
6,139,013 A 10/2000 Pierce et al.
6,142,872 A 11/2000 Walker et al.
6,142,875 A 11/2000 Kodachi et al.
6,146,273 A 11/2000 Olsen
6,152,823 A 11/2000 Lacoste et al.
6,155,925 A 12/2000 Giobbi et al.
6,159,095 A 12/2000 Frohm et al.
6,159,096 A 12/2000 Yoseloff
6,159,097 A 12/2000 Gura
6,162,122 A 12/2000 Acres et al.
6,168,520 B1 1/2001 Baerlocher et al.
6,174,233 B1 1/2001 Sunaga et al.
6,174,235 B1 1/2001 Walker et al.

(56) References Cited

U.S. PATENT DOCUMENTS 6,174,237 B1 1/2001 Stephenson
6,183,366 B1 2/2001 Goldberg et al.
6,186,894 B1 2/2001 Mayeroff
6,190,255 B1 2/2001 Thomas et al.
6,193,606 B1 2/2001 Walker et al.
6,203,010 B1 3/2001 Jorasch et al.
6,203,429 B1 3/2001 Demar et al.
6,203,430 B1 3/2001 Walker et al.
6,206,374 B1 3/2001 Jones
6,210,275 B1 4/2001 Olsen
6,210,277 B1 4/2001 Stefan
6,210,279 B1 4/2001 Dickinson
6,217,448 B1 4/2001 Olsen
6,220,593 B1 4/2001 Pierce et al.
6,220,961 B1 4/2001 Keane et al.
6,224,482 B1 5/2001 Bennett
6,224,484 B1 5/2001 Okuda et al.
6,224,486 B1 5/2001 Walker et al.
6,227,971 B1 5/2001 Weiss
6,231,445 B1 5/2001 Acres
6,234,897 B1 5/2001 Frohm et al.
6,238,287 B1 5/2001 Komori et al.
6,238,288 B1 5/2001 Walker et al.
6,241,608 B1 6/2001 Torango
6,244,958 B1 6/2001 Acres
6,254,481 B1 7/2001 Jaffe et al.
6,254,483 B1 7/2001 Acres
6,257,981 B1 7/2001 Acres et al.
6,264,561 B1 7/2001 Saffari et al.
6,270,409 B1 8/2001 Shuster
6,270,412 B1 8/2001 Crawford et al.
6,287,202 B1 9/2001 Pascal et al.
6,293,865 B1 9/2001 Kelly et al.
6,293,866 B1 9/2001 Walker et al.
6,299,165 B1 10/2001 Nagano
6,309,298 B1 10/2001 Gerow
6,309,299 B1 10/2001 Weiss
6,312,330 B1 11/2001 Jones et al.
6,312,334 B1 11/2001 Yoseloff
6,315,660 B1 11/2001 DeMar et al.
6,315,662 B1 11/2001 Jorasch et al.
6,315,666 B1 11/2001 Mastera et al.
6,319,125 B1 * 11/2001 Acres ..... 463/25
6,322,078 B1 11/2001 Adams
6,322,309 B1 11/2001 Thomas et al.
6,328,649 B1 12/2001 Randall et al.
6,336,857 B1 1/2002 McBride
6,340,158 B2 1/2002 Pierce et al.
6,343,989 B1 2/2002 Wood et al.
6,354,592 B1 3/2002 Virzi
6,358,149 B1 3/2002 Schneider et al.
6,361,441 B1 3/2002 Walker et al.
6,371,852 B1 4/2002 Acres
6,375,567 B1 4/2002 Acres
6,375,569 B1 4/2002 Acres
6,379,248 B1 4/2002 Jorasch et al.
6,386,977 B1 5/2002 Hole
6,398,218 B1 6/2002 Vancura
6,398,219 B1 6/2002 Pierce et al.
6,406,369 B1 6/2002 Baerlocher et al.
6,413,162 B1 7/2002 Baerlocher et al.
6,416,408 B2 7/2002 Tracy et al.
6,416,409 B1 7/2002 Jordan
6,419,583 B1 7/2002 Crumby et al.
6,425,828 B2 7/2002 Walker et al.
6,431,983 B2 8/2002 Acres
6,435,511 B1 8/2002 Vancura et al.
6,435,968 B1 8/2002 Torango
6,439,995 B1 8/2002 Hughs-Baird et al.
6,443,837 B1 9/2002 Jaffe et al.
6,454,651 B1 9/2002 Yoseloff
6,461,241 B1 10/2002 Webb et al.
6,464,582 B1 10/2002 Baerlocher et al.
6,468,156 B1 10/2002 Hughs-Baird et al.
6,471,591 B1 10/2002 Crumby
6,506,118 B1 1/2003 Baerlocher et al.
6,508,707 B2 1/2003 DeMar et al.
6,511,375 B1 1/2003 Kaminkow
6,511,376 B2 1/2003 Walker et al.
6,514,141 B1 2/2003 Kaminkow et al.
6,533,658 B1 3/2003 Walker et al.
6,533,664 B1 3/2003 Crumby
6,546,374 B1 4/2003 Esposito et al.
6,549,912 B1 4/2003 Chen
6,554,283 B2 4/2003 Vancura et al.
6,554,709 B1 4/2003 Brenner et al.
6,565,434 B1 5/2003 Acres
6,565,436 B1 5/2003 Baerlocher
6,569,013 B1 5/2003 Taylor
6,569,015 B1 5/2003 Baerlocher et al.
6,575,830 B2 6/2003 Baerlocher et al.
6,575,832 B1 6/2003 Manfredi et al.
6,579,179 B2 6/2003 Poole et al.
6,589,115 B2 7/2003 Walker et al.
6,592,460 B2 7/2003 Torango
6,595,854 B2 7/2003 Hughs-Baird et al.
6,595,855 B2 7/2003 Sako
6,599,185 B1 7/2003 Kaminkow et al.
6,599,193 B2 7/2003 Baerlocher et al.
6,607,437 B2 8/2003 Casey et al.
6,607,441 B1 8/2003 Acres
6,609,971 B2 8/2003 Vancura
6,609,973 B1 8/2003 Weiss
6,616,531 B1 9/2003 Mullins
6,620,046 B2 9/2003 Rowe
6,626,758 B1 9/2003 Parham et al.
6,652,378 B2 11/2003 Cannon et al.
6,656,040 B1 12/2003 Brosnan et al.
6,656,047 B1 12/2003 Tarantino et al.
6,656,048 B2 12/2003 Olsen
6,656,052 B2 12/2003 Abramopoulos et al.
6,659,864 B2 12/2003 McGahn et al.
6,666,765 B2 12/2003 Vancura
6,682,419 B2 1/2004 Webb et al.
6,682,420 B2 1/2004 Webb et al.
6,688,977 B1 2/2004 Baerlocher et al.
6,692,355 B2 2/2004 Baerlocher et al.
6,695,700 B2 2/2004 Walker et al.
6,712,693 B1 3/2004 Hettinger
6,712,695 B2 3/2004 Mothwurf et al.
6,712,697 B2 3/2004 Acres
6,726,563 B1 4/2004 Baerlocher et al.
6,746,016 B2 6/2004 Perrie
6,746,328 B2 6/2004 Cannon et al.
6,749,510 B2 6/2004 Giobbi
6,758,750 B2 7/2004 Baerlocher et al.
6,764,397 B1 7/2004 Robb
6,776,714 B2 8/2004 Ungaro et al.
6,776,715 B2 8/2004 Price
6,780,110 B2 8/2004 Baerlocher et al.
6,790,141 B2 9/2004 Muir
6,800,030 B2 10/2004 Acres
6,802,778 B1 10/2004 Lemay et al.
6,805,352 B2 10/2004 Hunter
6,811,483 B1 11/2004 Webb et al.
6,814,664 B2 11/2004 Baerlocher et al.
6,817,948 B2 11/2004 Pascal et al.
6,832,957 B2 12/2004 Falconer
6,832,958 B2 12/2004 Acres et al.
6,835,134 B2 12/2004 Poole et al.
6,837,788 B2 1/2005 Cannon
6,851,674 B2 2/2005 Pierce et al.
6,852,030 B2 2/2005 Baerlocher et al.
6,860,810 B2 3/2005 Cannon et al.
6,869,361 B2 3/2005 Sharpless et al.
6,884,167 B2 4/2005 Walker et al.
6,884,168 B2 4/2005 Wood et al.
6,887,154 B1 5/2005 Luciano, Jr. et al.
6,896,261 B2 5/2005 Pierce et al.
6,899,625 B2 5/2005 Luciano, Jr. et al.
6,908,390 B2 6/2005 Nguyen et al.
6,910,964 B2 6/2005 Acres
6,913,532 B2 7/2005 Baerlocher et al.
6,918,832 B2 7/2005 Baerlocher et al.

(56) References Cited

U.S. PATENT DOCUMENTS 6,918,834 B2 7/2005 Vancura
6,935,958 B2 8/2005 Nelson
6,939,234 B2 9/2005 Beatty
6,955,600 B2 10/2005 Glavich et al.
6,966,834 B1 11/2005 Johnson
6,991,538 B2 1/2006 Cannon
7,029,395 B1 4/2006 Baerlocher
7,156,735 B2 1/2007 Brosnan et al.
7,241,219 B2 7/2007 Walker et al.
7,297,059 B2 11/2007 Vancura et al.
7,314,411 B2 1/2008 Lannert et al.
7,329,179 B2 2/2008 Baerlocher
7,341,518 B2 3/2008 Muskin
7,354,345 B2 4/2008 Bortnik et al.
7,393,280 B2 7/2008 Cannon
7,422,521 B2 9/2008 Peterson
7,513,828 B2 4/2009 Nguyen et al.
7,594,851 B2 9/2009 Falconer
7,758,417 B2 7/2010 Jorasch et al.
7,780,517 B2 8/2010 Saffari et al.
7,806,764 B2 10/2010 Brosnan et al.
7,846,018 B2 12/2010 Baerlocher
7,901,294 B2 3/2011 Walker et al.
8,021,222 B2 9/2011 Walker et al.
2001/0049303 A1 12/2001 Found
2002/0025850 A1 2/2002 Hafezi
2002/0045475 A1 4/2002 Glavich et al.
2002/0065123 A1 5/2002 Packes, Jr. et al.
2002/0071557 A1 6/2002 Nguyen
2002/0077167 A1 6/2002 Merari
2002/0094855 A1 7/2002 Berman
2002/0116615 A1 8/2002 Nguyen et al.
2002/0138594 A1 9/2002 Rowe
2002/0142822 A1 10/2002 Baerlocher et al.
2002/0142829 A1 10/2002 Inoue
2002/0152120 A1 10/2002 Howington
2002/0165023 A1 11/2002 Brosnan et al.
2002/0183105 A1* 12/2002 Cannon et al. ..... 463/16
2002/0187834 A1 12/2002 Rowe et al.
2002/0193162 A1 12/2002 Walker et al.
2002/0198036 A1 12/2002 Baerlocher et al.
2003/0027625 A1 2/2003 Rowe
2003/0027628 A1 2/2003 Luciano
2003/0027630 A1 2/2003 Kelly et al.
2003/0040360 A1 2/2003 Kaminkow
2003/0045350 A1 3/2003 Baerlocher et al.
2003/0050111 A1 3/2003 Saffari
2003/0054878 A1 3/2003 Benoy et al.
2003/0060254 A1 3/2003 Cuddy et al.
2003/0060266 A1 3/2003 Baerlocher
2003/0060269 A1 3/2003 Paulsen et al.
2003/0060272 A1 3/2003 Glavich et al.
2003/0060279 A1 3/2003 Torango
2003/0064772 A1 4/2003 Tempest et al.
2003/0064773 A1 4/2003 Baerlocher et al.
2003/0064785 A1 4/2003 Stone et al.
2003/0069056 A1 4/2003 Cormack et al.
2003/0069064 A1 4/2003 Ainsworth
2003/0073482 A1 4/2003 Baerlocher et al.
2003/0083943 A1 5/2003 Adams et al.
2003/0092484 A1 5/2003 Schneider et al.
2003/0119583 A1 6/2003 Kaminkow et al.
2003/0162584 A1 8/2003 Hughs-Baird et al.
2003/0162585 A1 8/2003 Bigelow et al.
2003/0181231 A1 9/2003 Vancura et al.
2003/0199321 A1 10/2003 Williams
2003/0207710 A1 11/2003 Rodgers et al.
2003/0207713 A1 11/2003 Taylor
2003/0211879 A1 11/2003 Englman
2003/0211884 A1 11/2003 Gauselmann
2003/0216166 A1 11/2003 Baerlocher et al.
2003/0222402 A1 12/2003 Olive
2003/0228904 A1 12/2003 Acres et al.
2003/0232640 A1 12/2003 Walker et al.
2003/0232647 A1 12/2003 Moser
2003/0236116 A1 12/2003 Marks et al.
2004/0009811 A1 1/2004 Torango
2004/0029631 A1 2/2004 Duhamel
2004/0038724 A1 2/2004 Asdale
2004/0043815 A1 3/2004 Kaminkow
2004/0048649 A1 3/2004 Peterson et al.
2004/0048652 A1 3/2004 Ching et al.
2004/0053672 A1 3/2004 Baerlocher
2004/0053683 A1 3/2004 Hartl et al.
2004/0072615 A1 4/2004 Maya et al.
2004/0087368 A1 5/2004 Gavselmann
2004/0087369 A1 5/2004 Tanaka et al.
2004/0137982 A1 7/2004 Cuddy et al.
2004/0147306 A1 7/2004 Randall et al.
2004/0152509 A1 8/2004 Hornik et al.
2004/0171416 A1 9/2004 Baerlocher et al.
2004/0171420 A1 9/2004 Baerlocher et al.
2004/0185929 A1 9/2004 Walker et al.
2004/0192431 A1 9/2004 Singer et al.
2004/0235552 A1 11/2004 Gauselmann
2004/0242297 A1 12/2004 Walker
2005/0026694 A1 2/2005 Kelly et al.
2005/0032573 A1 2/2005 Acres et al.
2005/0054429 A1 3/2005 Baerlocher et al.
2005/0070356 A1 3/2005 Mothwurf
2005/0075163 A1 4/2005 Cuddy et al.
2005/0079908 A1 4/2005 Pacey
2005/0079911 A1 4/2005 Nakatsu
2005/0101374 A1 5/2005 Acres
2005/0101375 A1 5/2005 Webb et al.
2005/0101379 A1 5/2005 Falconer
2005/0101384 A1 5/2005 Parham
2005/0107158 A1 5/2005 Kanisawa et al.
2005/0119047 A1 6/2005 Olive
2005/0121850 A1 6/2005 Pierce et al.
2005/0143168 A1 6/2005 Torango
2005/0159211 A1 7/2005 Englman
2005/0176488 A1 8/2005 Olive
2005/0192083 A1 9/2005 Iwamoto
2005/0192099 A1 9/2005 Nguyen et al.
2005/0197180 A1 9/2005 Kaminkow et al.
2005/0209004 A1 9/2005 Torango
2005/0215305 A1 9/2005 Pierce et al.
2005/0227754 A1 10/2005 Kaminkow et al.
2005/0239542 A1 10/2005 Olsen
2005/0267610 A1 12/2005 Shinoda
2005/0282626 A1 12/2005 Manfredi et al.
2006/0003829 A1 1/2006 Thomas
2006/0025210 A1 2/2006 Johnson
2006/0035694 A1 2/2006 Fuller
2006/0035706 A1 2/2006 Thomas et al.
2006/0040732 A1 2/2006 Baerlocher et al.
2006/0040736 A1 2/2006 Baerlocher et al.
2006/0052159 A1 3/2006 Cahill et al.
2006/0052161 A1 3/2006 Soukup et al.
2006/0052162 A1 3/2006 Soukup et al.
2006/0073889 A1 4/2006 Edidin et al.
2006/0073897 A1 4/2006 Englman et al.
2006/0121972 A1 6/2006 Walker et al.
2006/0154722 A1 7/2006 Walker et al.
2006/0178203 A1 8/2006 Hughes et al.
2006/0252508 A1 11/2006 Walker et al.
2007/0004508 A1 1/2007 Walker et al.
2007/0060247 A1 3/2007 Low et al.
2007/0060251 A9 3/2007 Pierce et al.
2007/0060319 A1 3/2007 Block et al.
2007/0077988 A1 4/2007 Friedman
2007/0135207 A1 6/2007 Tarantino
2007/0155482 A1 7/2007 Walker et al.
2007/0287532 A1 12/2007 Jackson
2007/0293293 A1 12/2007 Baerlocher et al.
2007/0293306 A1 12/2007 Nee et al.
2007/0298857 A1 12/2007 Schlottmann et al.
2007/0298873 A1 12/2007 Nguyen et al.
2008/0009334 A1 1/2008 Walker et al.
2008/0045344 A1 2/2008 Schlottmann et al.
2008/0064480 A1 3/2008 Randall
2008/0070680 A1 3/2008 Baerlocher et al.
2008/0070692 A1 3/2008 Schlottmann et al.

(56) References Cited

U.S. PATENT DOCUMENTS

| | | | |
|---|---|---|---|
| 2008/0070693 | A1 | 3/2008 | Schlottmann et al. |
| 2008/0070694 | A1 | 3/2008 | Schlottmann et al. |
| 2008/0070695 | A1 | 3/2008 | Baerlocher et al. |
| 2008/0076503 | A1 | 3/2008 | Mattice et al. |
| 2008/0076527 | A1 | 3/2008 | Low et al. |
| 2008/0102916 | A1 | 5/2008 | Kovacs et al. |
| 2008/0102934 | A1 | 5/2008 | Tan |
| 2008/0113759 | A1 | 5/2008 | Baerlocher |
| 2008/0176635 | A1 | 7/2008 | Randall |
| 2008/0182655 | A1 | 7/2008 | DeWaal et al. |
| 2008/0318668 | A1 | 12/2008 | Ching et al. |
| 2009/0042652 | A1 | 2/2009 | Baerlocher et al. |
| 2009/0088239 | A1 | 4/2009 | Iddings et al. |
| 2009/0104977 | A1 | 4/2009 | Zielinski |
| 2009/0124316 | A1 | 5/2009 | Baerlocher et al. |
| 2010/0016062 | A1 | 1/2010 | Baerlocher |
| 2010/0120506 | A1 | 5/2010 | Davis et al. |
| 2010/0124973 | A1 | 5/2010 | DeWaal et al. |
| 2010/0248821 | A1 | 9/2010 | Jorasch et al. |
| 2011/0111842 | A1 | 5/2011 | Walker et al. |

FOREIGN PATENT DOCUMENTS

| | | | |
|---|---|---|---|
| AU | 630112 | | 10/1990 |
| AU | 628330 | | 9/1992 |
| AU | 633469 | | 1/1993 |
| AU | 649009 | | 5/1994 |
| AU | 655801 | | 1/1995 |
| AU | 680920 | | 8/1997 |
| AU | 710015 | | 9/1997 |
| AU | 733599 | | 10/1997 |
| AU | 722969 | | 6/1998 |
| AU | 1998/63553 | | 10/1998 |
| AU | 707687 | | 7/1999 |
| AU | 709724 | | 9/1999 |
| AU | 711501 | | 10/1999 |
| AU | 714299 | | 12/1999 |
| AU | 716299 | | 2/2000 |
| AU | 721968 | | 7/2000 |
| AU | 722107 | | 7/2000 |
| AU | 728788 | | 1/2001 |
| AU | 2001/1000033 | | 11/2001 |
| AU | 748263 | | 5/2002 |
| AU | 749222 | | 6/2002 |
| AU | 750731 | | 7/2002 |
| AU | 754689 | | 11/2002 |
| AU | 758306 | | 3/2003 |
| DE | 3415114 | | 10/1985 |
| DE | 8710757 | | 11/1987 |
| DE | 3638100 | | 5/1988 |
| DE | 3917683 | | 12/1990 |
| DE | 4200254 | | 8/1993 |
| DE | 4301855 | | 7/1994 |
| DE | 19600787 | | 5/1997 |
| DE | 19613455 | | 8/1997 |
| DE | 19936196 | | 1/2001 |
| EP | 0 342 797 | | 11/1989 |
| EP | 0 444 932 | | 9/1991 |
| EP | 0 449 433 | | 10/1991 |
| EP | 0 798 676 | | 10/1997 |
| EP | 0 874 337 | | 10/1998 |
| EP | 0 926 645 | | 6/1999 |
| EP | 0 944 030 | | 9/1999 |
| EP | 0 945 837 | | 9/1999 |
| EP | 0 981 119 | | 2/2000 |
| EP | 0 984 408 | | 3/2000 |
| EP | 0 984 409 | | 3/2000 |
| EP | 1 003 138 | | 5/2000 |
| GB | 9 126 85 | | 12/1962 |
| GB | 2 083 936 | | 3/1982 |
| GB | 2 096 376 | | 10/1982 |
| GB | 2 097 160 | | 10/1982 |
| GB | 2 098 778 | | 11/1982 |
| GB | 2 100 905 | | 1/1983 |
| GB | 2 117 155 | | 10/1983 |
| GB | 2 117 952 | | 10/1983 |
| GB | 2 118 445 | | 11/1983 |
| GB | 2 137 392 | | 10/1984 |
| GB | 2 139 390 | | 11/1984 |
| GB | 2 142 457 | | 1/1985 |
| GB | 2 144 644 | | 3/1985 |
| GB | 2 147 773 | | 5/1985 |
| GB | 2 148 135 | | 5/1985 |
| GB | 2 151 054 | | 7/1985 |
| GB | 2 153 572 | | 8/1985 |
| GB | 2 161 008 | | 1/1986 |
| GB | 2 161 009 | | 1/1986 |
| GB | 2 170 636 | | 8/1986 |
| GB | 2 180 682 | | 4/1987 |
| GB | 2 181 589 | | 4/1987 |
| GB | 2 183 882 | | 6/1987 |
| GB | 2 191 030 | | 12/1987 |
| GB | 2 201 821 | | 9/1988 |
| GB | 2 222 712 | | 3/1990 |
| GB | 2 226 436 | | 6/1990 |
| GB | 2 226 907 | | 7/1990 |
| GB | 2 231 189 | | 11/1990 |
| GB | 2 282 690 | | 4/1995 |
| GB | 2 322 217 | | 8/1998 |
| GB | 2 328 311 | | 2/1999 |
| GB | 2 333 880 | | 8/1999 |
| GB | 2 353 128 | | 2/2001 |
| GB | 2 383 668 | | 7/2003 |
| GB | 2 387 703 | | 10/2003 |
| WO | WO 94/12256 | | 6/1994 |
| WO | WO 95/22811 | | 8/1995 |
| WO | WO 95/30944 | | 11/1995 |
| WO | WO 97/12338 | | 4/1997 |
| WO | WO 97/27568 | | 7/1997 |
| WO | WO 97/32285 | | 9/1997 |
| WO | WO 98/35309 | | 8/1998 |
| WO | WO 98/47115 | | 10/1998 |
| WO | WO 98/51384 | | 11/1998 |
| WO | WO 99/03078 | | 1/1999 |
| WO | WO 99/10849 | A1 | 3/1999 |
| WO | WO 00/12186 | | 3/2000 |
| WO | WO 00/32286 | | 6/2000 |
| WO | WO 00/66235 | | 11/2000 |
| WO | WO 00/76606 | | 12/2000 |
| WO | WO 01/82245 | A2 | 1/2001 |
| WO | WO 01/10523 | | 2/2001 |
| WO | WO 01/15055 | | 3/2001 |
| WO | WO 01/15790 | | 3/2001 |
| WO | WO 01/26019 | | 4/2001 |
| WO | WO 02/099760 | A2 | 12/2002 |
| WO | WO 03/030066 | | 4/2003 |
| WO | WO 2005/079242 | A2 | 9/2005 |

* cited by examiner

GAMING SYSTEM, GAMING DEVICE, AND METHOD CHANGING AWARDS AVAILABLE TO BE WON IN PENDING PLAYS OF A GAME BASED ON A QUANTITY OF CONCURRENTLY PENDING PLAYS OF THE GAME

PRIORITY CLAIM

This application is a continuation of, and claims priority to and the benefit of, U.S. patent application Ser. No. 13/240,478, filed on Sep. 22, 2011, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices that provide players awards in primary or base games are well known. These gaming devices generally require a player to place a wager or pay a fee to initiate a play of the primary game. Upon receipt of the wager or fee, the gaming devices display a play of the primary game, display an outcome for the play of the primary game, and in some instances provide the player an award associated with the outcome of the primary game. Certain commercially available gaming devices provide bonus awards, bonus events, or both to a player based on the player's rate of play of the primary game. Generally, the faster a player plays the primary game, the more likely the gaming device will provide the player with a bonus award and/or a bonus event.

Certain other commercially available gaming devices enable players to play more than one wagering game simultaneously. Certain of these gaming devices enable players to play multiple plays of a same wagering game simultaneously, multiple plays of different wagering games simultaneously, or both. Providing a gaming device in which a player may play multiple plays of one or more wagering games at once enhances player enjoyment and excitement by reducing the boredom and monotony of playing a single play of the same wagering game several consecutive times at the same gaming device. Therefore, to increase player enjoyment and excitement, it is desirable to provide players with new types of gaming devices enabling simultaneous wagering game play that include new and different schemes and features, such as primary game features and bonus game features. A continuing need thus exists to provide new and exciting gaming devices and methods providing simultaneous wagering game play.

SUMMARY

Various embodiments of the gaming systems, gaming devices, and methods of operating the gaming systems and gaming devices of the present disclosure are configured to change one or more awards available to be won by a player for an initiated but not completed play of a game (i.e., a pending play of a game) based on a quantity of concurrently pending plays of the game. In various embodiments, the gaming system of the present disclosure enables a player to sequentially initiate multiple plays of a game such that a plurality of those plays are concurrently pending. Each play of the game includes one or more awards available to be won (i.e., winnable awards) in that play of the game. In certain embodiments, when a quantity of concurrently pending plays of the game is greater than or equal to a designated quantity of plays of the game, the gaming system changes one or more of the winnable awards of one or more of those concurrently pending plays of the game. For example, the gaming system may change the winnable awards of one of the concurrently pending plays of the game such that the average expected payback percentage and/or the volatility of that play of the game changes.

In some embodiments, those changed winnable awards remain changed as long as the quantity of concurrently pending plays of the game is greater than or equal to (or, in some embodiments, greater than) the designated quantity of plays of the game. In these embodiments, after any winnable awards are changed, if the quantity of concurrently pending plays of the game falls below the designated quantity of plays of the game, the gaming system returns any changed winnable awards of any pending plays of the game to their original states. In other embodiments, those changed winnable awards remain changed regardless of whether the quantity of concurrently pending plays of the game is greater than or equal to (or, in some embodiments, greater than) the designated quantity of plays of the game.

In certain embodiments, the gaming system enables a plurality of players to play a community or multi-player version of a game. In one of these embodiments, the players compete against one another to achieve the highest quantity of concurrently pending plays of the game within a predetermined time period. After expiration of the predetermined time period, the gaming system ranks the players based on each player's achieved highest quantity of concurrently pending plays of the game, and provides awards and/or bonus or secondary events or features based on the ranking.

Additional features and advantages are described herein, and will be apparent from, the following Detailed Description and the Figures.

BRIEF DESCRIPTION OF THE FIGURES

FIGS. 4A, 48, 4C, and 4D are front views of a display device of another example embodiment of a gaming system or gaming device of the present disclosure and illustrate a plurality of concurrently pending plays of a slot game in which the gaming system does not change any changed winnable awards back to their unchanged states when the quantity of concurrently pending plays of the slot game falls below the designated quantity of plays.

DETAILED DESCRIPTION

Gaming Device and Electronics

The present disclosure may be implemented in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

Figure 1A:
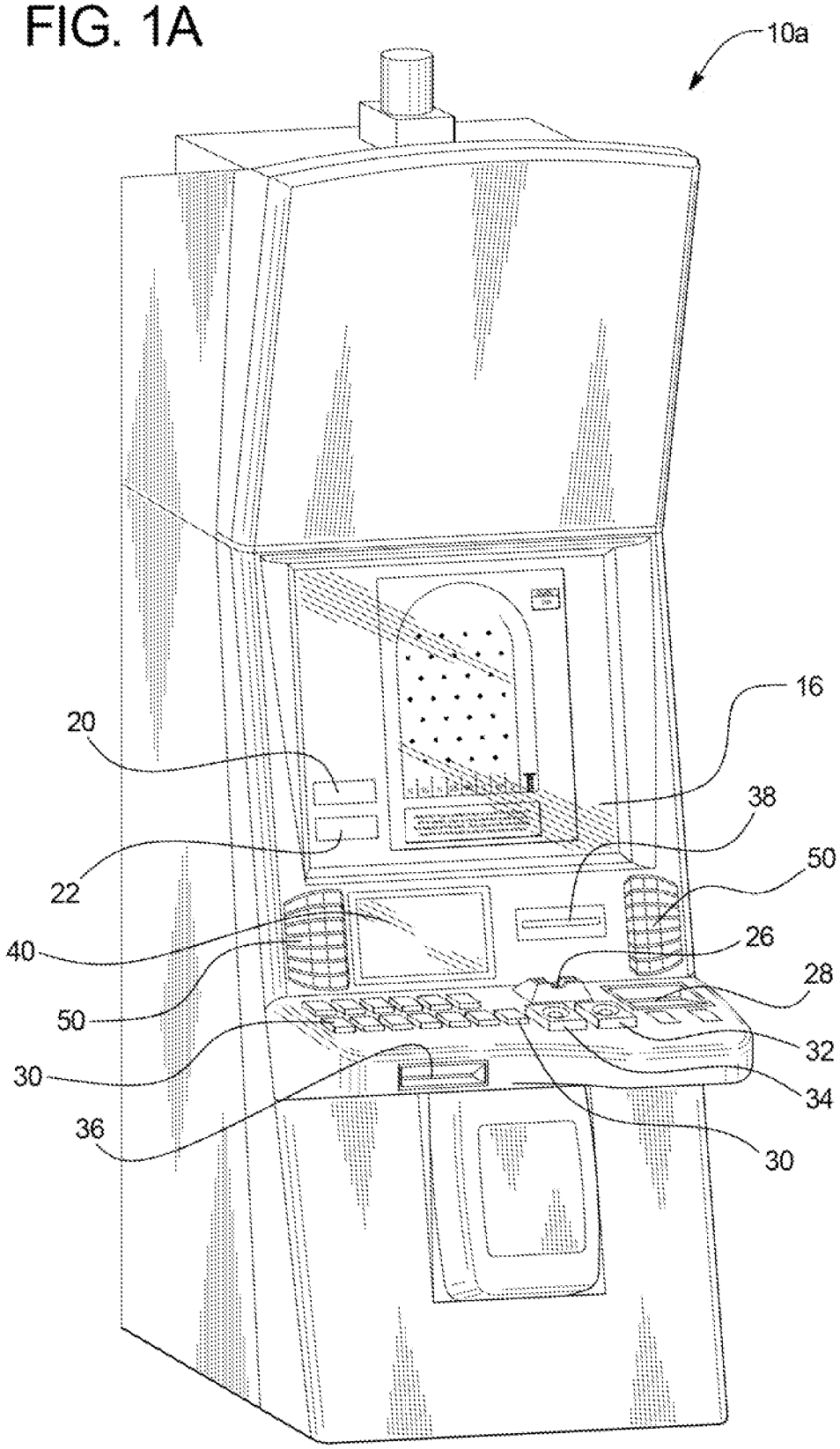
FIGS. 1A and 1B are front perspective views of alternative embodiments of gaming devices disclosed herein.
Figure 1B:
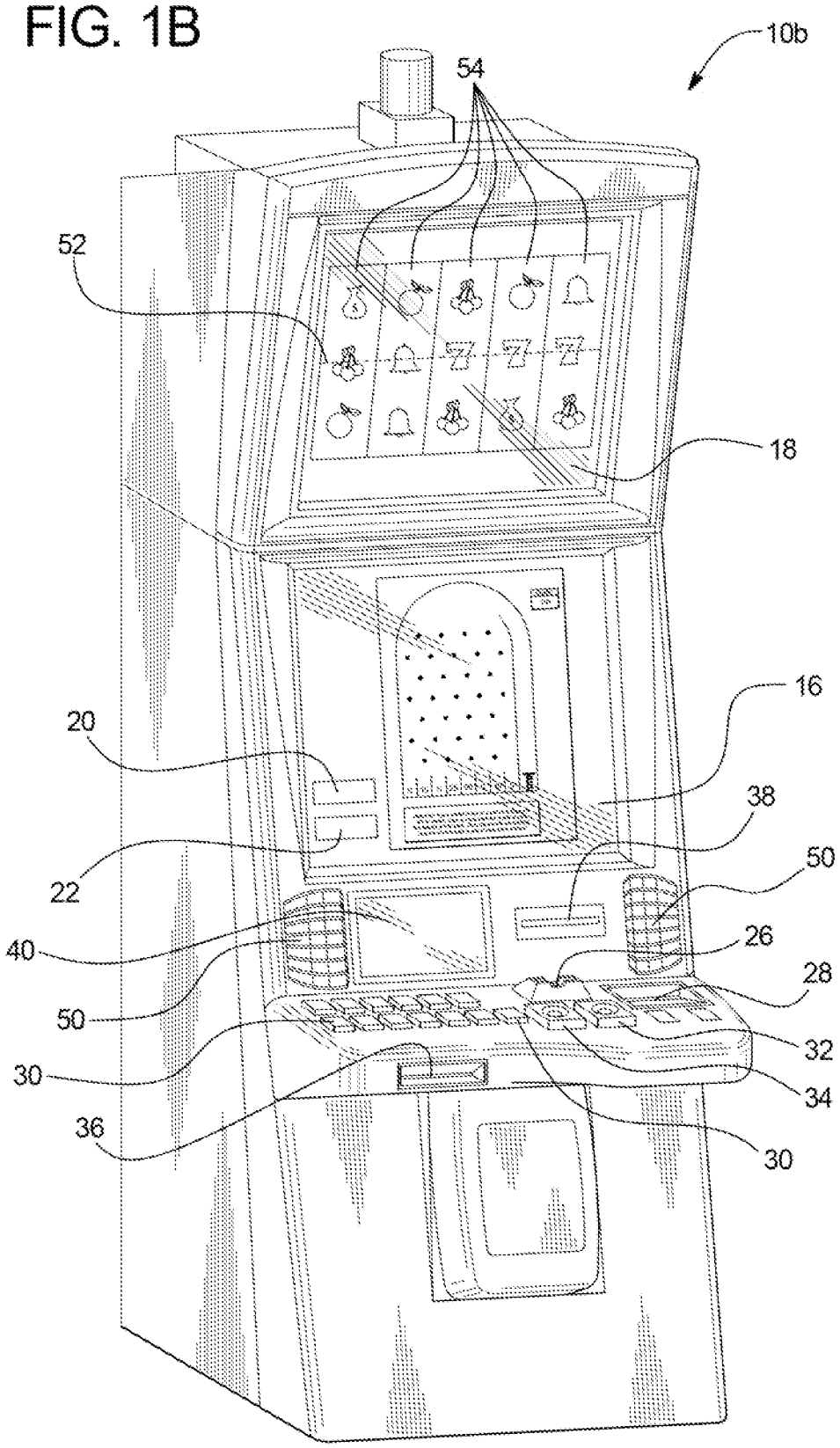

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (not shown) that a player may operate preferably while sitting. As illustrated by the different configurations shown in FIGS. 1A and 1B, the gaming device may have varying cabinet and display configurations.

Figure 2A:
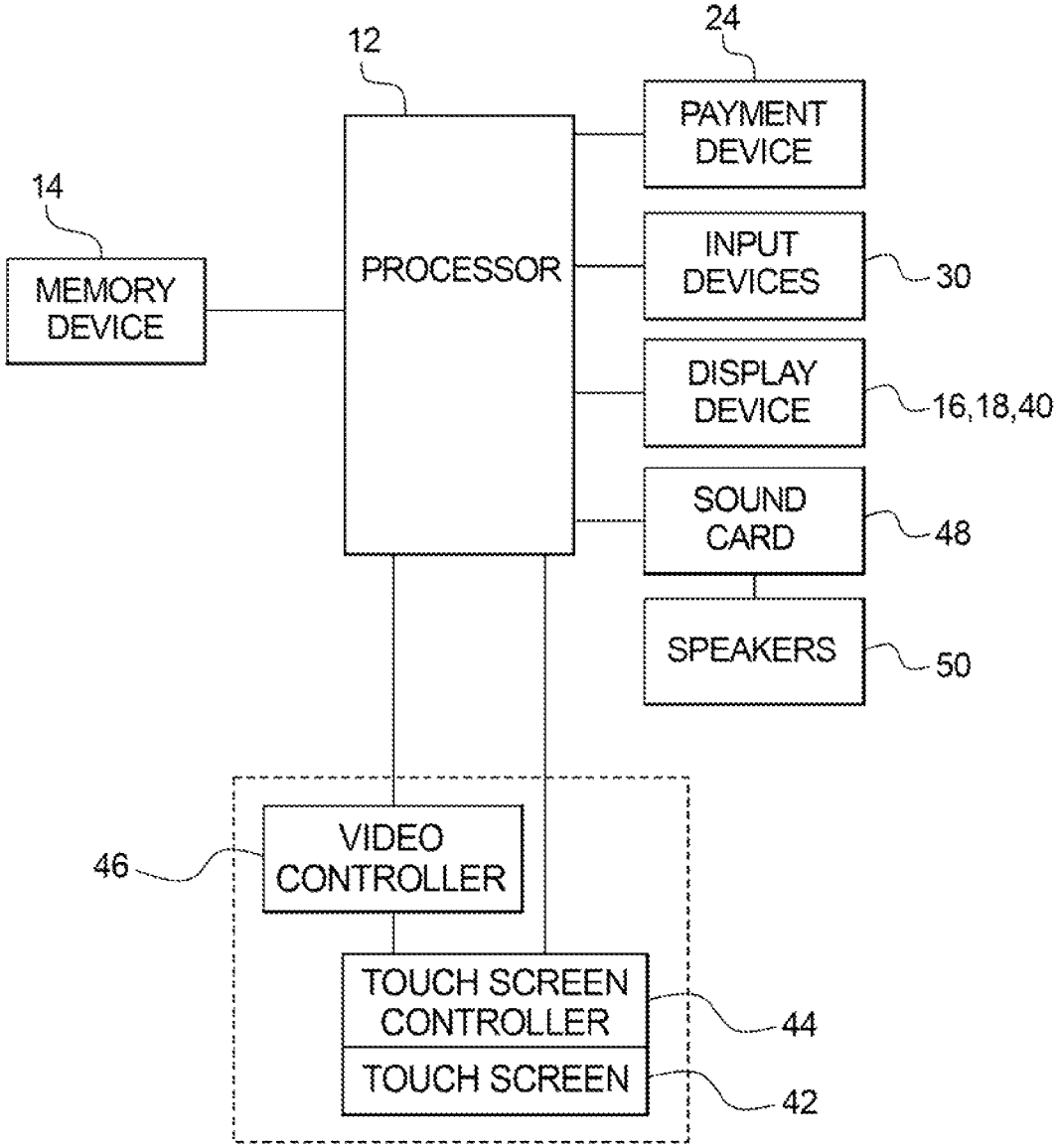
FIG. 2A is a schematic block diagram of an electronic configuration of one embodiment of a gaming device disclosed herein.

In one embodiment, as illustrated in FIG. 2A, the gaming device includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, non-transitory computer readable medium, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player, in one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays any suitable base or primary game. This display device may also display any suitable secondary or bonus game associated with the base or primary game as well as information relating to the base or primary game or the secondary or bonus game. The alternative embodiment shown in FIG. 1B includes a central display device 16 and an upper display device 18. The upper display device may display the base or primary game, any suitable secondary or bonus game associated or not associated with the base or primary game, and/or information relating to the base or primary game or the secondary or bonus game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the base or primary game or the secondary or bonus game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28, into which the player inserts paper money, a ticket, or voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and preferably a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start the base or primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and preferably a plurality of speakers 50 or other sound generating hardware and/or software for generating sounds, such as by playing music for the base or primary game and/or the secondary or bonus game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the base or primary game and/or the secondary or bonus game as a game image, symbol, or indicia.

Gaming device 10 incorporates the base or primary game and any secondary or bonus game associated with the base or primary game. The gaming machine or device may include some or all of the features of conventional gaming machines or devices. The gaming device may incorporate any suitable reel-type game, card game, cascading or falling symbol game, number game, or other game of chance susceptible to representation in an electronic or electromechanical form as a secondary or bonus game or feature, which in one embodiment produces a random outcome based on probability data at the time of or after placement of a wager. That is, different base or primary games or secondary or bonus games, such as video poker games, video blackjack games, video keno games, and video bingo games may be implemented.

In one embodiment, the base or primary game and/or the secondary or bonus game includes one or more paylines associated with a plurality of symbol display positions. The paylines may be horizontal, vertical, circular, diagonal, angled, or any combination thereof. In this embodiment, the gaming device includes at least one and preferably a plurality of reels, such as three to five reels, in either electromechanical form with mechanical rotating reels or video form with simulated reels and movement thereof. In one embodiment, an electromechanical slot machine includes a plurality of adjacent, rotatable reels that may be combined and operably coupled with an electronic display of any suitable type. In another embodiment, if the reels are in video form, one or more of the display devices, as discussed above, displays the plurality of simulated video reels. Each reel displays a plurality of indicia or symbols, such as bells, hearts, fruits, numbers, letters, bars, or other images that preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels stop spinning if specified types and/or configurations of indicia or symbols occur on an active payline or otherwise occur in a winning pattern, occur on the requisite number of adjacent reels, and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols that are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if a reel is activated based on the player's wager, then each of the symbol positions of that reel will be activated and each of the active symbol positions will be part of one or more of the ways to win. In one embodiment, if a reel is not activated based on the player's wager, then a designated number of default symbol positions, such as a single symbol position of the middle row of the reel, will be activated and the default symbol position(s) will be part of one or more of the ways to win. This type of gaming machine enables a player to wager on one, more than one, or all of the reels, and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols that form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols that were previously classified or formed from related symbols on the first and second reels.

After analyzing each of the remaining strings of related symbols, the gaming device determines, for each remaining pending or incomplete string of related symbols, if any of the symbols from the next adjacent reel should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, base or primary game or the secondary or bonus game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the base or primary game or the secondary or bonus game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, the base or primary game or the secondary or bonus game may be a keno game wherein the gaming device displays a plurality of selectable indicia or numbers on at least one of the display devices. In this embodiment, the player selects at least one of a plurality of the selectable indicia or numbers via an input device such as a touch screen. The gaming device then displays a series of drawn numbers and determines an amount of matches, if any, between the player's selected numbers and the gaming device's drawn numbers. The player is provided an award based on the amount of matches, if any, based on the amount of determined matches and the number of numbers drawn.

In one embodiment, as noted above, in addition to winning credits or other awards in the base or primary game, the gaming device may also give players the opportunity to win credits in a secondary or bonus game or in a secondary or bonus round. The secondary or bonus game enables the player to obtain a prize or payout in addition to the prize or payout, if any, obtained from the base or primary game. In general, a secondary or bonus game produces a significantly higher level of player excitement than the base or primary game because it provides a greater expectation of winning than the base or primary game, and is accompanied with more attractive or unusual features than the base or primary game. In one embodiment, the secondary or bonus game may be any type of suitable game, either similar to or completely different from the base or primary game.

In one embodiment, the triggering event or qualifying condition may be a selected outcome in the base or primary game or a particular arrangement of one or more indicia on a display device in the base or primary game, such as a BONUS symbol appearing on three adjacent reels along a payline in the base or primary game. In other embodiments, the triggering event or qualifying condition occurs based on exceeding a certain amount of game play (such as number of games, number of credits, amount of time), or reaching a specified number of points earned during game play.

In another embodiment, gaming device processor 12 or central controller 56 randomly provides the player one or more plays of one or more secondary or bonus games. In one such embodiment, the gaming device does not provide any apparent reason to the player for qualifying to play a secondary or bonus game. In this embodiment, qualifying for a secondary or bonus game is not triggered by an event in or based specifically on any of the plays of the base or primary game. That is, the gaming device may simply qualify a player to play a secondary or bonus game without any explanation or alternatively with simple explanations. In another embodiment, the gaming device (or central server) qualifies a player for a secondary or bonus game at least partially based on a game triggered or symbol triggered event, such as at least partially based on the play of the base or primary game.

In one embodiment, the gaming device includes a program that will automatically begin a secondary or bonus round after the player has achieved a triggering event or qualifying condition in the base or primary game. In another embodiment, after a player has qualified for a secondary or bonus game, the player may subsequently enhance the player's secondary or bonus game participation through continued play of the base or primary game. Thus, for each secondary or bonus qualifying event, such as a bonus symbol, that the player obtains, a given number of secondary or bonus game wagering points or credits may be accumulated in a "bonus meter" programmed to accrue the secondary or bonus wagering credits or entries toward eventual participation in a secondary or bonus game. The occurrence of multiple such secondary or bonus qualifying events in the base or primary game may result in an arithmetic or exponential increase in the number of secondary or bonus wagering credits awarded. In one embodiment, the player may redeem extra secondary or bonus wagering credits during the secondary or bonus game to extend play of the secondary or bonus game.

In one embodiment, no separate entry fee or buy-in for a secondary or bonus game is needed. That is, a player may not purchase entry into a secondary or bonus game; rather, the player must win or earn entry through play of the base or primary game, thus encouraging play of the base or primary game. In another embodiment, qualification of the secondary or bonus game is accomplished through a simple "buy-in" by the player—for example, if the player has been unsuccessful at qualifying through other specified activities. In another embodiment, the player must make a separate side-wager on the secondary or bonus game or wager a designated amount in the base or primary game to qualify for the secondary or bonus game. In this embodiment, the secondary or bonus game triggering event must occur and the side-wager (or designated base or primary game wager amount) must have been placed to trigger the secondary or bonus game.

Figure 2B:
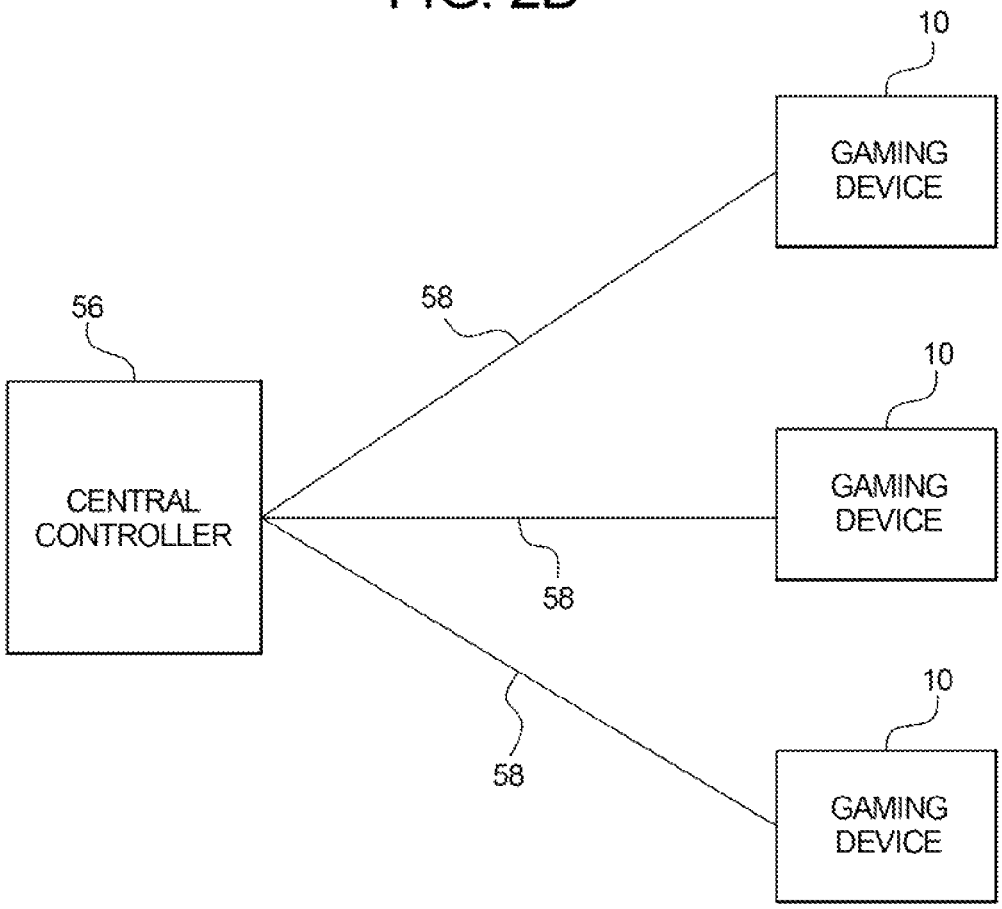
FIG. 2B is a schematic diagram of the central server in communication with a plurality of gaming devices in accordance with one embodiment of the gaming system disclosed herein.

In one embodiment, as illustrated in FIG. 2B, one or more of gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the base or primary game based on probability data. In another embodiment, the central server or controller randomly generates a game outcome for the secondary or bonus game based on probability data. In another embodiment, the central server or controller randomly generates a game outcome for both the base or primary game and the secondary or bonus game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a base or primary game outcome, a secondary or bonus game outcome, base or primary game and secondary or bonus game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the base or primary game or the secondary or bonus game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first game, and a second gaming device to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the players birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for the base or primary game, a secondary or bonus game, or both. In another embodiment, the game program may be executable as a secondary or bonus game to be played simultaneous with the play of the base or primary game (that may be downloaded to or affixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate the base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of the base or primary game. That is, a player is provided a progressive award without any explanation or, alternatively, with simple explanations. In another embodiment, a player is provided a progressive award at least partially based on a game triggered or symbol triggered event, such as at least partially based on the play of the base or primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the base or primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the base or primary game of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the base or primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Changing Awards Available to be Won in Pending Plays of a Game Based on a Quantity of Concurrently Pending Plays of the Game Various embodiments of the gaming systems, gaming devices, and methods of operating the gaming systems and gaming devices of the present disclosure are configured to change one or more awards available to be won by a player (i.e., winnable awards) for an initiated but not completed play of a game (i.e., a pending play of a game) based on a quantity of concurrently pending plays of the game. Generally, the gaming system of the present disclosure enables a player to sequentially initiate multiple plays of a game such that a plurality of those plays are concurrently pending. Each play of the game includes one or more winnable awards that may be provided to the player for that play of the game. When a quantity of concurrently pending plays of the game is greater than or equal to a designated quantity of plays of the game, the gaming system changes one or more of the winnable awards of one or more of those concurrently pending plays of the game. In certain embodiments, those changed winnable awards remain changed as long as the quantity of concurrently pending plays of the game is greater than or equal to (or, in some embodiments, greater than) the designated quantity of plays of the game. In this embodiment, after any winnable awards are changed, if the quantity of concurrently pending plays of the game falls below the designated quantity of plays of the game, the gaming system returns any changed winnable awards of any pending plays of the game to their original states. It should thus be appreciated that players are incentivized to quickly initiate sequential plays of the game so that the gaming system changes the winnable awards for one or more of those plays of the game and the players may take advantage of any changed winnable awards (which are advantageous to the players). It should also be appreciated that players are incentivized to maintain a high quantity of pending plays at once to maintain any changed winnable awards.

FIGS. 3A, 3B, 3C, 3D, 3E, and 3F illustrate screen shots of a display device of an example embodiment of the gaming system and gaming device of the present disclosure configured to change one or more winnable awards of a pending play of a game based on a quantity of concurrently pending plays of the game. The game in this example is an obstacle board game, though it should be appreciated that any suitable game may be employed, such as a spinning reel-type slot game, a card game such as blackjack or poker, a roulette game, a keno game, or a bingo game.

Figure 3A:
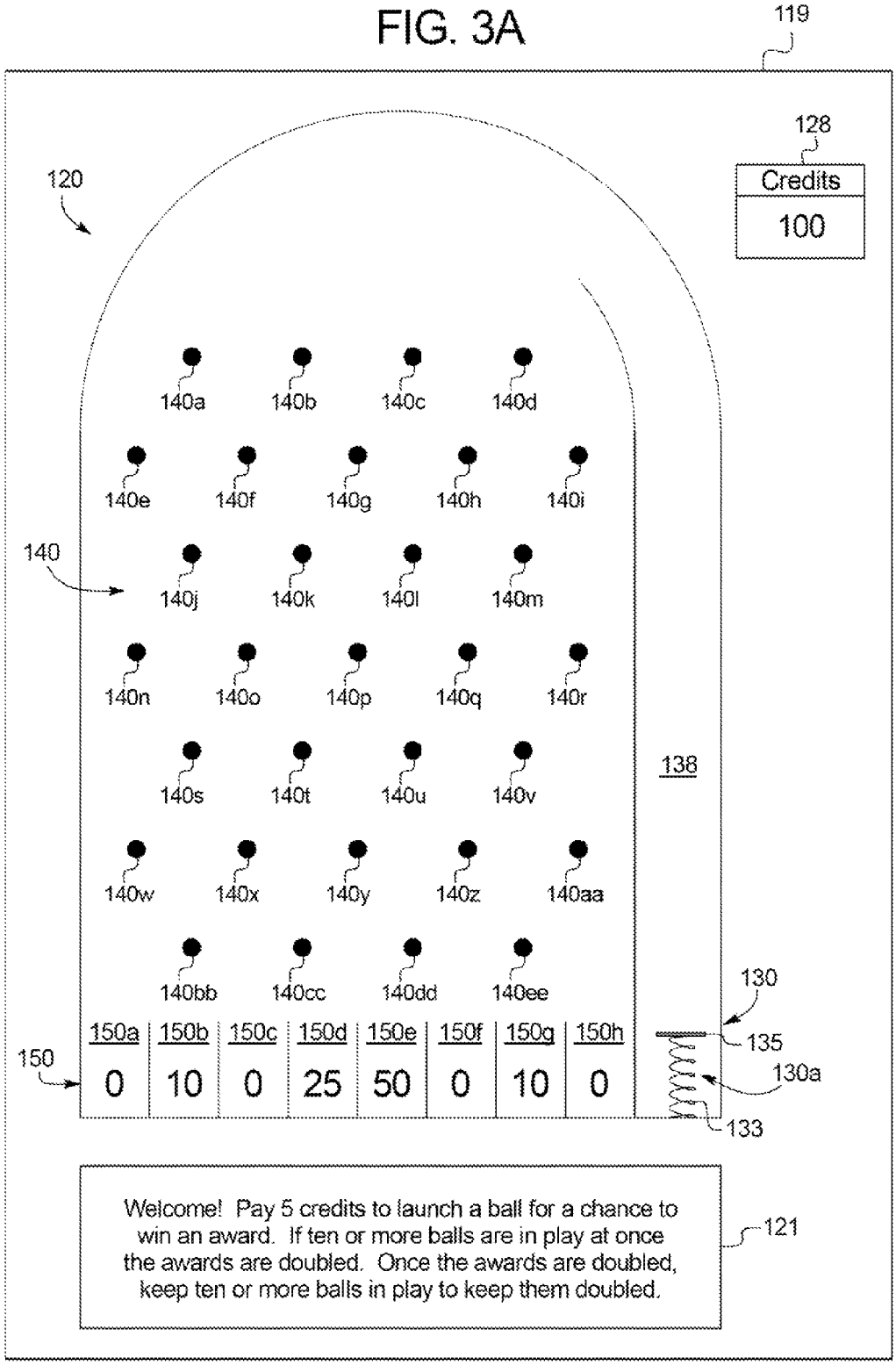
FIGS. 3A, 3B, 3C, 3D, 3E, and 3F are front views of a display device of an example embodiment of a gaming system or gaming device of the present disclosure and illustrate a plurality of concurrently pending plays of an obstacle board game in which the gaming system changes any changed winnable awards back to their unchanged states when the quantity of concurrently pending plays of the obstacle board game falls below the designated quantity of plays.

As shown in FIG. 3A, in this embodiment the gaming system includes a display device 119 that displays an obstacle board game area 120. Obstacle board game area 120 includes an object starting area 130, an obstacle area 140, and an object ending area 150 positioned beneath obstacle area 140. Object starting area 130 includes an object starting position 130*a* positioned at the bottom of a chute 138 located at one side of obstacle board game area 120. Object starting position 130*a* includes a spring 133 and an object launch pad 135 connected to the top of spring 133. In this embodiment, for each play of the obstacle board game, an object (such as a ball) is introduced onto the object launch pad 135. The spring is then compressed and released, which causes the object to travel out of chute 138 and into obstacle area 140. It should be appreciated that, in this embodiment, each object represents a different play of the obstacle board game. It should also be appreciated that, in certain embodiments, the object starting area does not include the spring and/or the object launch pad.

Obstacle area 140 includes obstacles 140*a*, 140*b*, 140*c*, 140*d*, 140*e*, 140*f*, 140*g*, 140*g*, 140*h*, 140*i*, 140*j*, 140*k*, 140*l*, 140*m*, 140*n*, 140*o*, 140*p*, 140*q*, 140*r*, 140*s*, 140*t*, 140*u*, 140*v*, 140*w*, 140*x*, 140*y*, 140*z*, 140*aa*, 140*bb*, 140*cc*, 140*dd*, and 140*ee*. In this embodiment, obstacles 140*a* to 140*ee* are pegs, and are referred to herein as pegs 140*a* to 140*ee*. Similarly, obstacle area 140 is referred to herein as peg area 140. Each of pegs 140*a* through 140*ee* is associated with a set of coordinates within peg area 140. Each set of coordinates defines the position at which that peg is displayed within peg area 140. In certain embodiments, the coordinates of adjacent pegs are equidistant from one another, and in other embodiments, the coordinates of adjacent pegs are not equidistant from one another. In other words, the distance between the coordinates of certain adjacent obstacles may vary in certain embodiments and may not vary in other embodiments.

Object ending area 150 includes object ending positions 150*a*, 150*b*, 150*c*, 150*d*, 150*e*, 150*f*, 150*g*, and 150*h*. In this embodiment, each of the object ending positions is associated with an award that may be provided to a player for a play of the obstacle board game. In other words, each of the object ending positions is associated with a winnable award. Specifically, object ending position 150*a* is associated with a winnable award of 0 credits, object ending position 150*b* is associated with a winnable award of 10 credits, object ending position 150*c* is associated with a winnable award of 0 credits, object ending position 150*d* is associated with a winnable award of 25 credits, object ending position 150*e* is associated with a winnable award of 50 credits, object ending position 150*f* is associated with a winnable award of 0 credits, object ending position 150*g* is associated with a winnable award of 10 credits, and object ending position 150*h* is associated with a winnable award of 0 credits. It should be appreciated than the object ending positions may be associated with any suitable winnable awards. It should also be appreciated that any suitable types of winnable awards may be employed. It should further be appreciated that, in certain embodiments, fewer than all of the object ending positions are associated with a winnable award.

It should be appreciated that the object starting area may include any suitable quantity of object starting positions and may be configured in any suitable manner. For example, in certain embodiments the object starting area is located above the obstacle area. These embodiments may not include the spring or the object launch pad. Rather, in these embodiments objects are released from the object starting area and fall into and through the obstacle area. In some embodiments including a plurality of object starting positions, the gaming system randomly determines which of the object starting positions to employ, while in other embodiments the gaming system enables the player to determine which of the object starting positions to employ. It should also be appreciated that the obstacle area may include any suitable quantity of obstacles and that the obstacle ending area may include any suitable quantity of obstacle ending positions. It should further be appreciated that the object starting area may include object starting positions that are not uniform in size, that the object ending area may include object ending positions that are not uniform in size, and that the obstacle area may include obstacles that are not uniform in size. The obstacles may be of any suitable shape, and any suitable types of obstacles may be employed.

In this embodiment, a player establishes a credit balance on the gaming system prior to playing the obstacle board slot game. The player's credit balance is displayed in credit meter 128. After establishing a credit balance, when the player wishes to play the obstacle board game, the player actuates a "PLAY" or "LAUNCH" button (not shown) or makes another suitable input to initiate a play of the obstacle board slot game.

After the player initiates a play of the obstacle board slot game, the gaming system: (a) deducts the cost of the play of the obstacle board game from the player's credit balance, (b) displays an object at object starting position 130*a* on object launch pad 135, (c) displays the object being launched up and out of chute 138, and (d) displays the object falling through peg area 140 and into one of object ending positions 150*a* to 150*h*. The gaming system provides the player with the winnable award associated with the object ending position in which the object lands, and that play of the obstacle board game ends.

More specifically, after the object is launched up and out of chute 138, it falls into peg area 140 as if pulled by gravity (or, in electromechanical embodiments including a physical objects, a physical obstacle board, and physical obstacles, is pulled by gravity and falls into the obstacle area) until it collides with or hits one of pegs 140*a* through 140*ee*. When the object collides with one of pegs 140*a* to 140*ee* (i.e., when the outer edge of the object touches or intersects with the outer edge of one of pegs 140*a* through 140*ee*), the object changes direction and may or may not change speed. This occurs because pegs 140*a* through 140*ee* and are, in this embodiment, immovable. According to the laws of physics, since the pegs do not move when hit by the object, the object must change direction, speed, or both. Accordingly, after being launched into peg area 140, the object travels through peg area 140 and collides with one or more of pegs 140*a* through 140*ee* until it falls into or lands in one of object ending positions 150*a* to 150*h* in a manner described in detail below. It should be appreciated that, in certain embodiments, when multiple objects are falling through the obstacle area simultaneously, the objects interact with one another in a manner similar to the way in which the objects interact with the obstacles (as described further below).

In this embodiment, which includes a virtual obstacle board, virtual obstacles, and virtual objects, the gaming system determines the manner in which the object travels from object starting position 130*a* through peg area 140 and into one of object ending positions 150*a* to 150*h*. In other words, the gaming system determines at least: (a) the path the object will follow after exiting chute 138; (b) which of pegs 140*a* through 140*ee* the object will collide with while falling through peg area 140, (c) which direction the object will fall after it collides with each peg, and (d) which one of object ending positions 150*a* to 150*h* the object will fall into. Put differently, the gaming system determines an object path in which the object: (a) begins at the object starting position 130*a*, (b) proceeds up and out of chute 138, (c) collides with one of more of pegs 140*a* through 140*ee* while falling through peg area 140, and (d) ends at one of object ending positions 150*a* to 150*h*. After the gaming system determines the object path, the display device displays the object moving from the object starting position up and out of the chute and into the peg area; to each of the pegs along the determined object path; and, ultimately, into the object ending position at the end of the determined object path.

The gaming system determines the object path in one of a plurality of different ways. In certain embodiments, the gaming system stores every possible object path. In other words, the gaming system stores each possible path through the obstacle area along which an object may move after being launched from the object starting position. In one of these embodiments, the gaming system determines the object path by selecting one of the stored object paths. The gaming system then displays the object moving from the object starting position along the selected stored object path through the obstacle area and into the object ending position at the end of the selected stored object path. It should be appreciated that the gaming system selects one of the stored object paths in any suitable manner, such as randomly, based on game play, based on a player input, based on weighted values, or based on a probability table or tables.

In certain other embodiments, the gaming system determines the object path by dynamically generating the object path while the object is falling through the obstacle area. In these embodiments, when the object collides with an obstacle or another object the gaming system determines the direction in which the object will fall or travel after colliding with the obstacle or object. In one of these embodiments, when the object collides with an obstacle or object the gaming system randomly determines the direction in which the object will fall or travel. Thus, in this embodiment, there is an equal likelihood that the object will fall to the right or to the left of an obstacle after a collision with the obstacle and in any direction after a collision with an object. In another one of these embodiments, when the object collides with an obstacle or object the gaming system determines the direction in which the object will fall or travel based on weighted values. Therefore, in this embodiment, it is more likely that an object will fall to either the left or the right after a collision with an obstacle and in certain directions after a collision with an object. The weighted values can be determined in any suitable manner, such as (but not limited to), based on game play, based on a player input, based on a probability table or tables, or randomly. In another one of these embodiments, the gaming system uses a physics engine to determine the direction in which the object will fall or travel after colliding with an obstacle or another object. In this embodiment, the physics engine may take the size and shape of the object or objects into account when determining the direction in which the object will travel after colliding with an obstacle or object.

It should be appreciated that in various embodiments the gaming system enables the player to make one or more of a plurality of inputs to control the manner in which the object is launched into the obstacle area. In certain embodiments, the gaming system enables the player to control the compression of the spring, which enables the player to control the speed at which the object travels upon leaving the object launch pad. That is, in these embodiments the gaming system enables the player to control the object launch speed. In other embodiments, the gaming system enables the player to control the object launch direction. In certain other embodiments, the gaming system enables the player to control the launch spin of the object (e.g., clockwise or counter clockwise and, in some embodiments, how fast the object is spinning). It should thus be appreciated that in various embodiments the gaming system enables the player to directly control one or more of the object launch speed, launch direction, or launch spin when an object is launched. In certain embodiments, the gaming system takes one or more of the player determined object launch speed, launch direction, or launch spin into account when determining the object's path through the object area, as described in detail above.

FIGS. 3A, 3B, 3C, 3D, 3E, and 3F illustrate an example of one embodiment of the gaming system and gaming device of the present disclosure (referred to herein as "gaming system" for brevity). As shown in FIG. 3A, when the gaming system is not being played by a player, display device 119 displays an attract screen that includes a welcome message in indication box 121. The welcome message provides an invitation to pay five credits to initiate a play of the obstacle board game and launch an object from object starting position 130*a* up and out of chute 138 and into peg area 140. In this example, each launched object represents a different play of the obstacle board game. After a player initiates a play of the obstacle board game, the gaming system enables the player to initiate a subsequent play of the obstacle board game prior to completion of that previous play of the obstacle board game. In other words, the gaming system enables the player to sequentially launch another object before the previously-launched object falls into one of the object ending positions. It should be appreciated that since an appreciable period of time (for example, four to five seconds) elapses between the initiation and the completion of a play of the obstacle board game (i.e., between the time an object is launched up and out of the chute and falls through the obstacle area into one of the object ending positions), multiple plays of the obstacle board game may be concurrently pending. That is, if the player sequentially initiates a plurality of plays of the obstacle board game (i.e., launches a plurality of objects) quickly enough, those plays will be pending at the same time.

In this embodiment, when at least a designated quantity of plays of the obstacle board game are concurrently pending, the gaming system changes the winnable awards associated with one or more of the object ending positions. In this embodiment, the designated quantity of plays is ten plays, and the gaming system changes the winnable awards associated with each of the object ending positions by doubling the amounts of the winnable awards. The welcome message provides a notification that the gaming system will double the amounts of the winnable awards associated with the object ending positions when at least ten plays of the obstacle board game have been initiated but are not complete. In other words, when at least ten objects are in play at once, the gaming system doubles the amounts of the winnable awards associated with the object ending positions. It should thus be appreciated that players of the obstacle board game are incentivized to quickly initiate sequential plays of the obstacle board game so that the gaming system changes the winnable awards for each concurrently pending play of the obstacle board game. It should also be appreciated that players are incentivized to maintain a high quantity of objects in play at once to maintain any changed winnable awards.

In this embodiment, each play of the obstacle board game includes the same set of winnable awards. Specifically, each play of the obstacle board game includes the set of winnable awards associated with the obstacle ending positions. In other words, whenever a play of the obstacle board game is initiated, the winnable awards included in that play of the obstacle board game are the winnable awards that are associated with the obstacle ending positions. It should be appreciated, however, that in other embodiments each or a plurality of plays of the game include different winnable awards.

While, in this embodiment, the gaming system enables the player to pay a predetermined cost or fee to initiate a play of the obstacle board game, it should be appreciated that in other embodiments the gaming system enables the player to wager one of a plurality of wager amounts on a play of the game. In certain of these embodiments, the gaming system enables the player to wager a relatively high amount for a play of the game having relatively larger winnable awards, or the gaming system enables the player to wager a relatively low amount for a play of the game having relatively smaller winnable awards.

While, in this embodiment, the gaming system enables the player to initiate a single play of the obstacle board game at once, it should be appreciated that in other embodiments the gaming system enables the player to initiate more than one play of the obstacle board game at once. For example, in one of these embodiments the gaming system enables the player to pay double the fee or place twice a standard wager amount to initiate two plays of the game at once.

It should be appreciated that the designated quantity of plays may be any suitable quantity of plays. In certain embodiments, the designated quantity of plays is predetermined. In various embodiments, the gaming system determines the designated quantity of plays: (a) randomly, (b) based on a wager placed by the player, (c) based on an input made by the player, (d) based on information stored in a player tracking account associated with the player, (e) based on plays of the obstacle board game being played by other players (such as in a community or multi-player game setting or a tournament setting); or (f) in any other suitable manner.

It should also be appreciated that the gaming system changes one or more of the winnable awards in any suitable manner, such as (but not limited to) by: (a) increasing one or more of the winnable awards by a designated amount, (b) increasing one or more of the winnable awards by a multiplier value, (c) increasing one or more of the winnable awards by a percentage, (d) replacing one or more of the a winnable wards with one or more winnable awards of a different type, (e) replacing one or more of the winnable awards with one or more winnable awards from a predetermined set of winnable awards, (f) providing additional winnable awards of a different type (such as non-monetary awards) in addition to the existing winnable awards, (g) changing the average expected payback percentage of the play of the game, (h) changing the volatility of the game, (i) providing a bonus round in addition to or instead of a winnable award (that may or may not provide the player with additional awards), and (j) providing a play of a different game in addition to or instead of a winnable award (that may or may not provide the player with additional awards).

In certain embodiments, rather than or in addition to changing one or more winnable awards, the gaming system provides the player with one or more non-monetary awards when the quantity of concurrently pending plays equals or exceeds the designated quantity of plays. For example, in one embodiment the gaming system provides the player with an achievement for reaching certain milestone quantities of concurrently pending plays, such as thirty-five plays, forty plays, and fifty plays. In some embodiments, the gaming system provides the player with an indicator, such as a title, an icon, or an animation, such that the player is identified as having achieved those milestone quantities of concurrently pending plays.

Figure 3B:
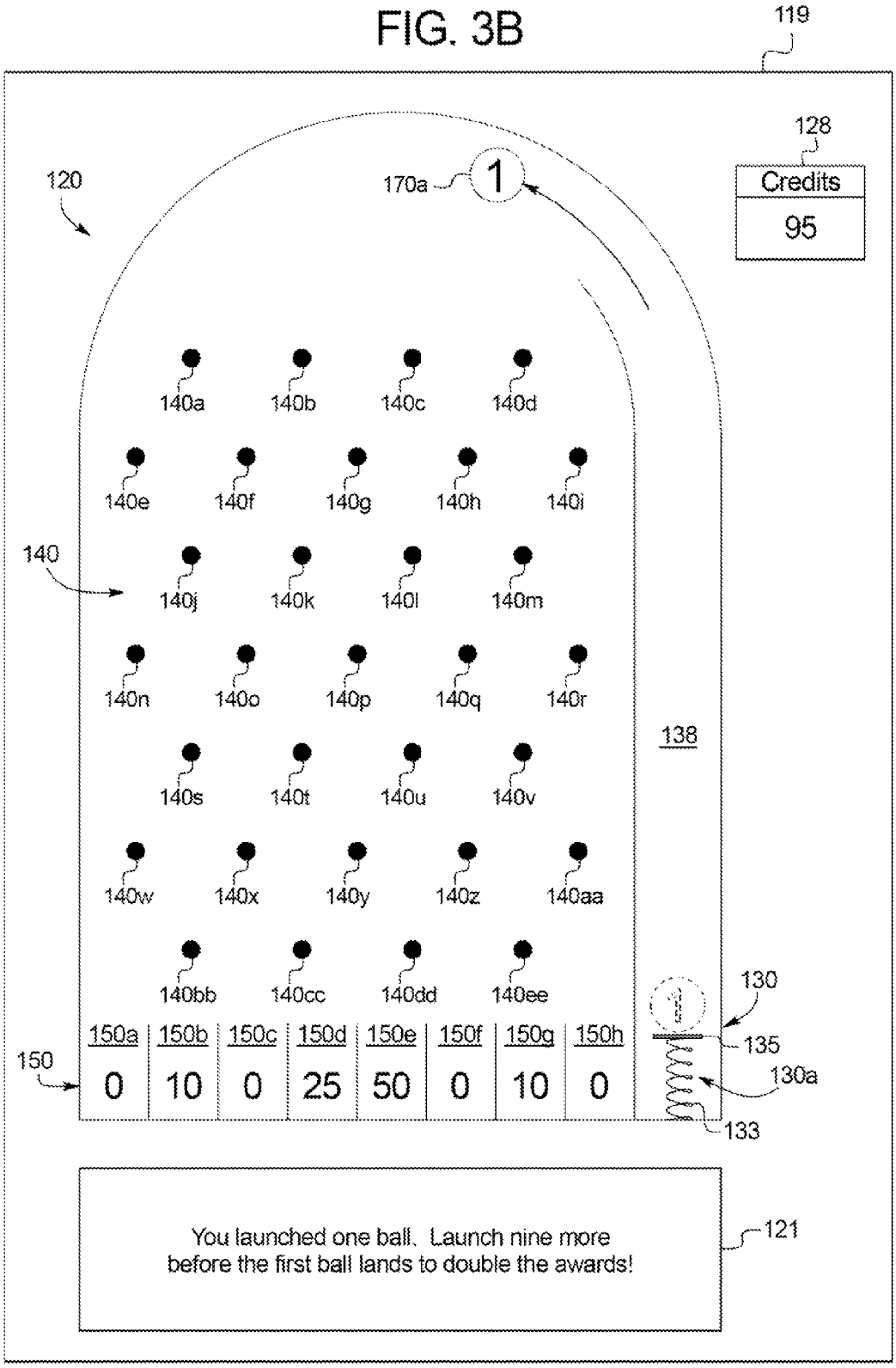

As illustrated in FIG. 3B, the player initiates a first play of the obstacle board game. Upon initiation of the first play of the obstacle board game, the gaming system: (a) decreases the player's credit balance from 100 credits to 95 credits to reflect the 5 credit cost of the first play of the obstacle board game, as shown in credit meter 128; (b) displays an object 170*a* at object starting position 130*a* on object launch pad 135; (c) determines an object path (not shown) for object 170*a* in one of the manners described above; and (d) displays object 170*a* being launched up and out of chute 138 into peg area 140 along the determined object path. The winnable awards associated with the first play of the obstacle board game are the winnable awards associated with object ending positions 150*a* to 150*h*. Since one play of the obstacle board game is currently pending, indication box 121 displays a message including a notification that the gaming system will double the amounts of the winnable awards associated with the object ending positions (i.e., the winnable awards associated with the first play of the game) if the player initiates but does not complete nine additional plays of the obstacle board game before the first play of the obstacle board game is complete (i.e., before object 170*a* lands in one of object ending areas 150*a* to 150*h*). Put differently, if the player initiates but does not complete nine additional plays of the obstacle board game before the first play of the obstacle board game is complete, the gaming system will double the winnable awards associated with each of those ten concurrently pending plays. As illustrated in FIG. 3B, since object 170*a* represents the first play of the obstacle board game, object 170*a* is labeled with the numeral "1" for clarity to distinguish it from any subsequent concurrently pending plays of the obstacle board game. It should be appreciated that the objects may be labeled in any suitable manner and with any suitable indicia. It should also be appreciated that the objects may be distinguished from one another in any suitable manner. It should further be appreciated that in certain embodiments the objects may not be distinguishable from one another.

It should be appreciated that upon the player's initiation of the first play of the game, the gaming system begins monitoring the game play to determine the quantity of concurrently pending plays of the game. This enables the gaming system to change the winnable awards when the quantity of concurrently pending plays of the game equals or exceeds the designated quantity of plays of the game. In this embodiment, the gaming system monitors the game play by determining the quantity of concurrently pending plays of the game at predetermined time intervals (such as ten or more times per second), though it should be appreciated that any suitable manner of monitoring may be employed. For example, in another embodiment, the gaming system monitors the game play by periodically determining the difference between a quantity of initiated plays during a predetermined time period (such as a time period beginning upon initiation of a gaming session) and a quantity of completed plays during that predetermined time period. This difference represents the quantity of concurrently pending plays of the game for that gaming session.

Figure 3C:
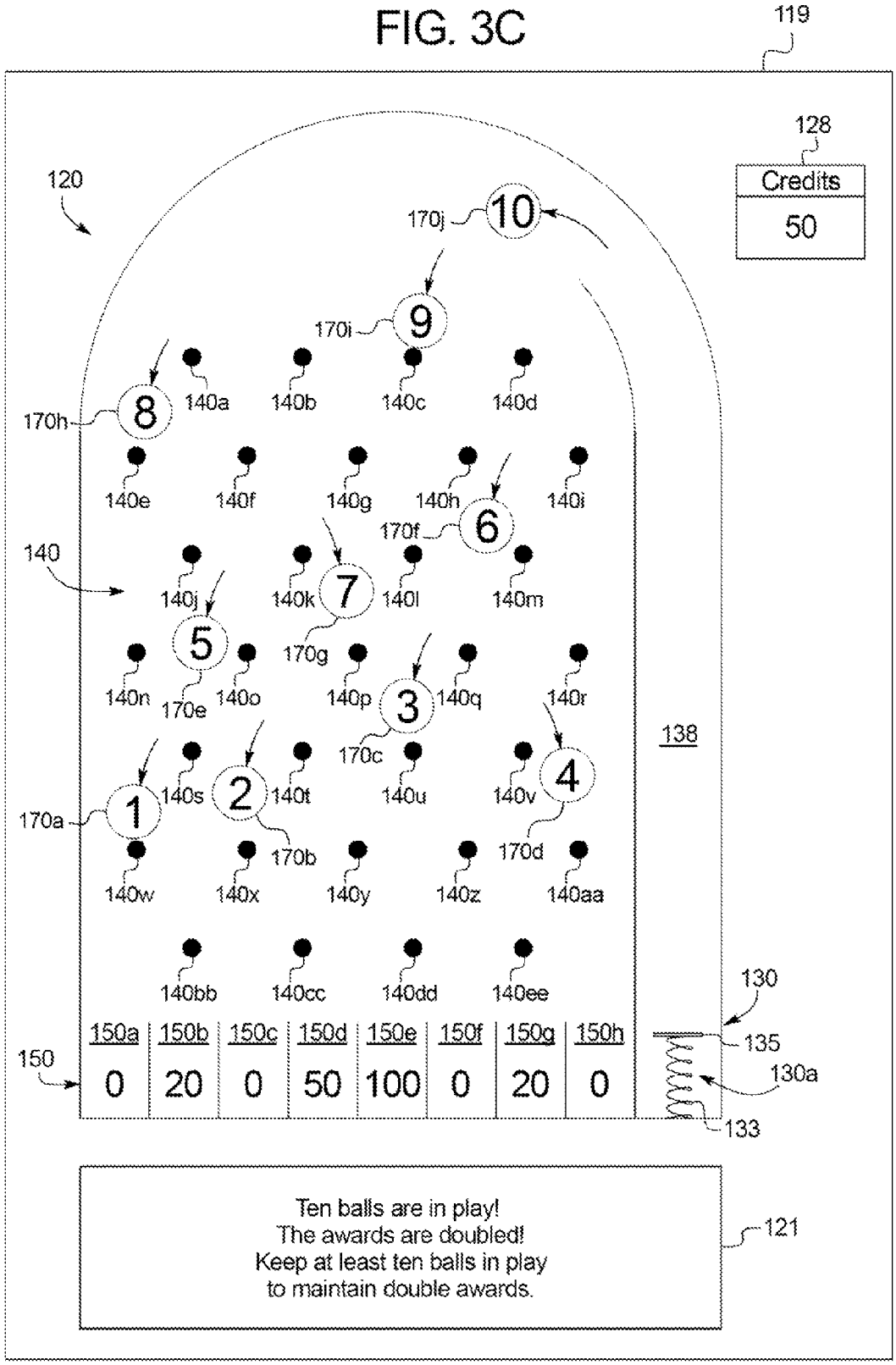

As illustrated in FIG. 3C, prior to completion of the first play of the obstacle board game (i.e., before the fist object lands in one of the object ending positions), the player initiated but did not complete nine additional plays of the obstacle board game. Upon initiation of each of the additional plays, the gaming system: (a) reduced the player's credit balance by 5 credits to reflect the 5 credit cost of that play of the obstacle board game; (b) displayed an object 170*b* (second play), 170*c* (third play), 170*d* (fourth play), 170*e* (fifth play), 170*f* (sixth play), 170*g* (seventh play), 170*h* (eighth play), 170*i* (ninth play), or 170*j* (tenth play) at object starting position 130*a* on object launch pad 135; (c) determined an object path (not shown) for that object in one of the manners described above; and (d) displayed that object being launched up and out of chute 138 into peg area 140 along the determined object path. Accordingly, the player's credit balance decreased from 95 to 50 credits, as shown in credit meter 128, and ten objects (objects 170*a* to 170*j*) are concurrently present within the obstacle board area. Put differently, ten plays of the obstacle board game are concurrently pending.

Since at least ten plays of the obstacle board game are concurrently pending, the gaming system automatically doubles the amounts of the winnable awards associated with the object ending positions when the gaming system determines that at least ten plays of the obstacle board game are concurrently pending. In other words, the gaming system automatically doubles the amounts of the winnable awards associated with each of the ten concurrently pending plays of the obstacle board game. Thus, as illustrated in FIG. 3C, after the gaming system doubles the winnable awards, object ending position 150*a* is associated with a changed winnable award of 0 credits (2×0 credits), object ending position 150*b* is associated with a changed winnable award of 20 credits (2×10 credits), object ending position 150*c* is associated with a changed winnable award of 0 credits (2×0 credits), object ending position 150*d* is associated with a changed winnable award of 50 credits (2×25 credits), object ending position 150*e* is associated with a changed winnable award of 100 credits (2×50 credits), object ending position 150*f* is associated with a changed winnable award of 0 credits (2×0 credits), object ending position 150*g* is associated with a changed winnable award of 20 credits (2×10 credits), and object ending position 150*h* is associated with a changed winnable award of 0 credits (2×0 credits).

In this embodiment, the amounts of the changed winnable awards remain changed until fewer than ten plays of the obstacle board game are concurrently pending. In other words, the amounts of the changed winnable awards remain changed until fewer than ten objects are concurrently present within obstacle board area 120. Once fewer than ten plays of the obstacle board game are concurrently pending, the gaming system returns the changed winnable awards to their original values. To this end, the gaming system displays a message in indication box 121 including a notification to keep at least ten objects in play at once to maintain the changed winnable awards.

Figure 3D:
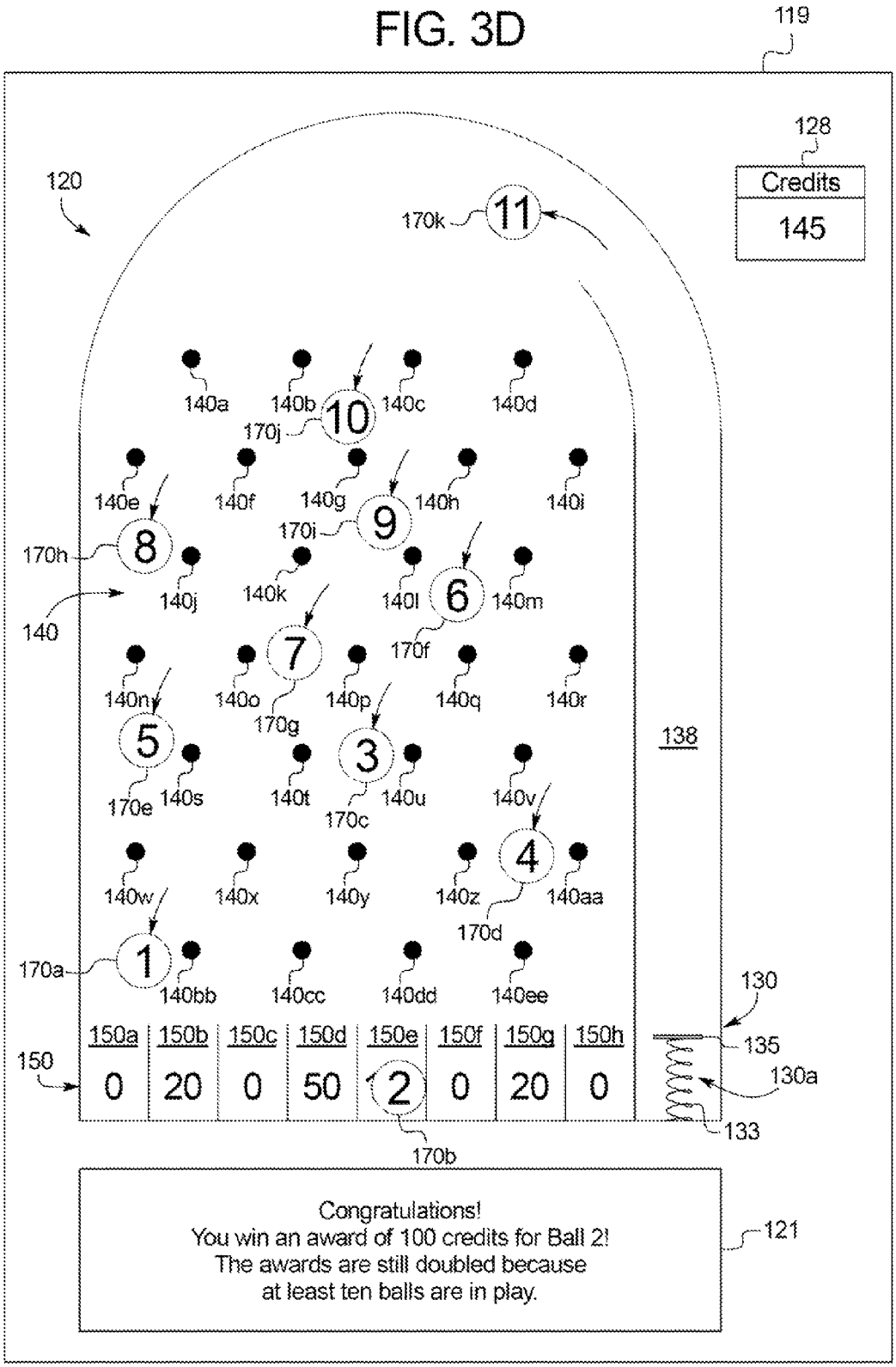

As illustrated in FIG. 3D, before any of the ten concurrently pending plays of the obstacle board game are completed (i.e., before any objects 170*a* to 170*h* fall into one of the object ending positions), the player initiates an eleventh play of the obstacle board game. The gaming system: (a) reduces the player's credit balance from 50 credits to 45 credits to reflect the 5 credit cost of the eleventh play of the obstacle board game (not shown); (b) displays an object 170*k* at object starting position 130*a* on object launch pad 135; (c) determines an object path (not shown) for object 170*k* in one of the manners described above; and (d) displays object 170*k* being launched up and out of chute 138 into peg area 140 along the determined object path. Since, at this point, there are more than ten concurrently pending plays of the obstacle board game, the winnable awards associated with the object ending positions remain changed. Thus, the changed winnable awards associated with the eleven concurrently pending plays of the obstacle board game remain changed.

After the initiation of the eleventh play of the obstacle board game, object 170*b* falls into object ending area 150*e*. The gaming system provides the player with the changed winnable award of 100 credits associated with object ending area 150*e* and increases the player's credit balance from 45 credits to 145 credits, as shown in credit meter 128. The second play of the obstacle board game is, therefore, complete. Since ten plays of the obstacle board game (the first and third to eleventh plays) are still concurrently pending after completion of the second play of the obstacle board game, the changed winnable awards associated with the first and third to eleventh plays of the obstacle board game remain changed and indication box 121 displays a message to the player including a notification that the changed winnable awards remain changed because ten objects are in play at once.

Figure 3E:
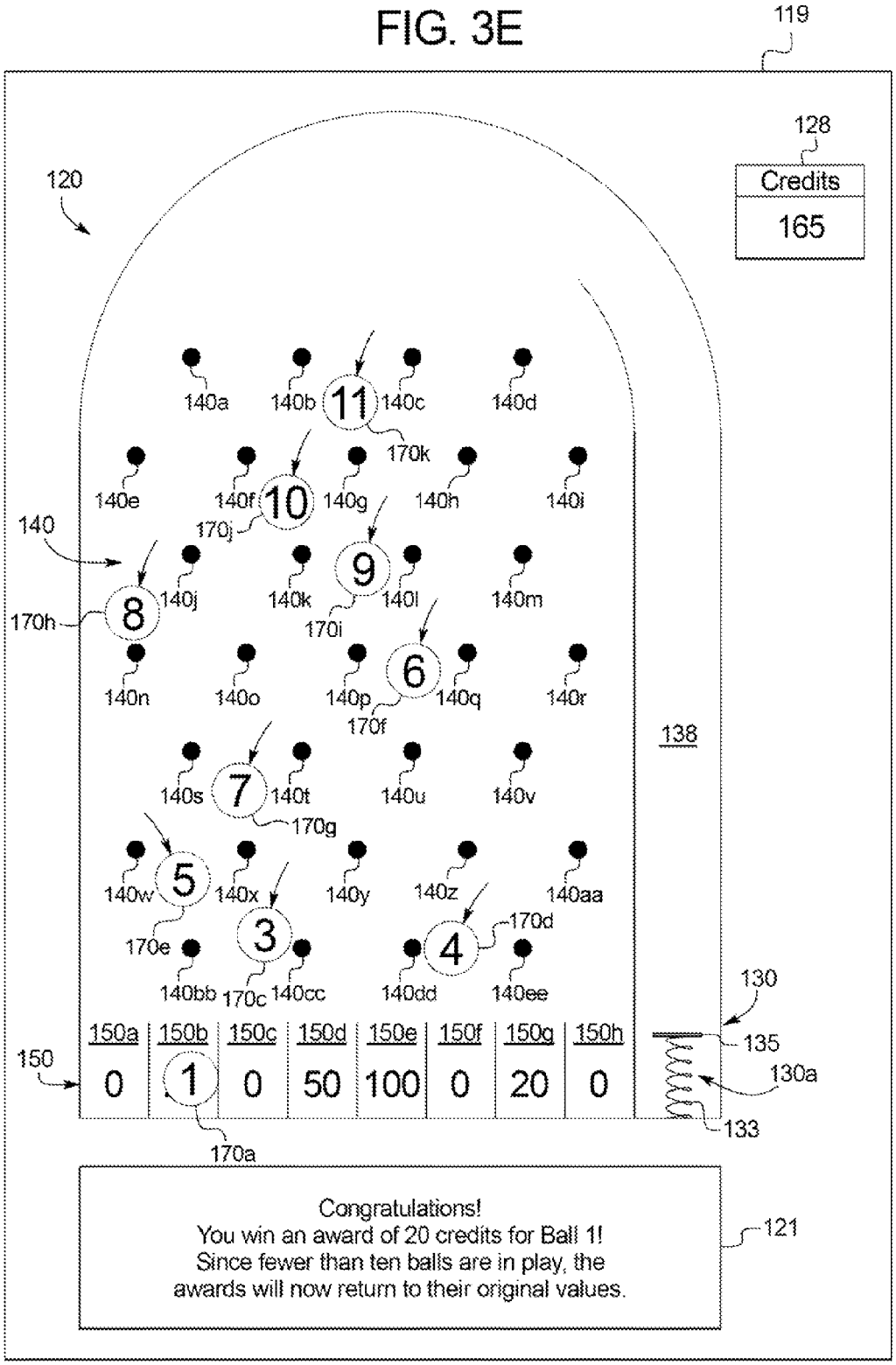

As illustrated in FIG. 3E, object 170*a* falls into object ending position 150*b*. The gaming system provides the player with the changed winnable award of 20 credits associated with object ending area 150*b* and increases the player's credit balance from 145 to 165 credits, as shown in credit meter 128. The first play of the obstacle board game is, therefore, complete. Since at this point fewer than ten plays of the obstacle board game are concurrently pending (the third to eleventh plays) the gaming system automatically returns the changed winnable awards associated with the third to eleventh plays of the obstacle game to their original values when the gaming system determines that fewer than ten plays of the obstacle board game are concurrently pending. Put differently, the winnable awards return to their original values because the quantity of concurrently pending plays of the obstacle board game (nine plays) is less than the designated quantity of plays of the obstacle board game (ten plays).

Figure 3F:
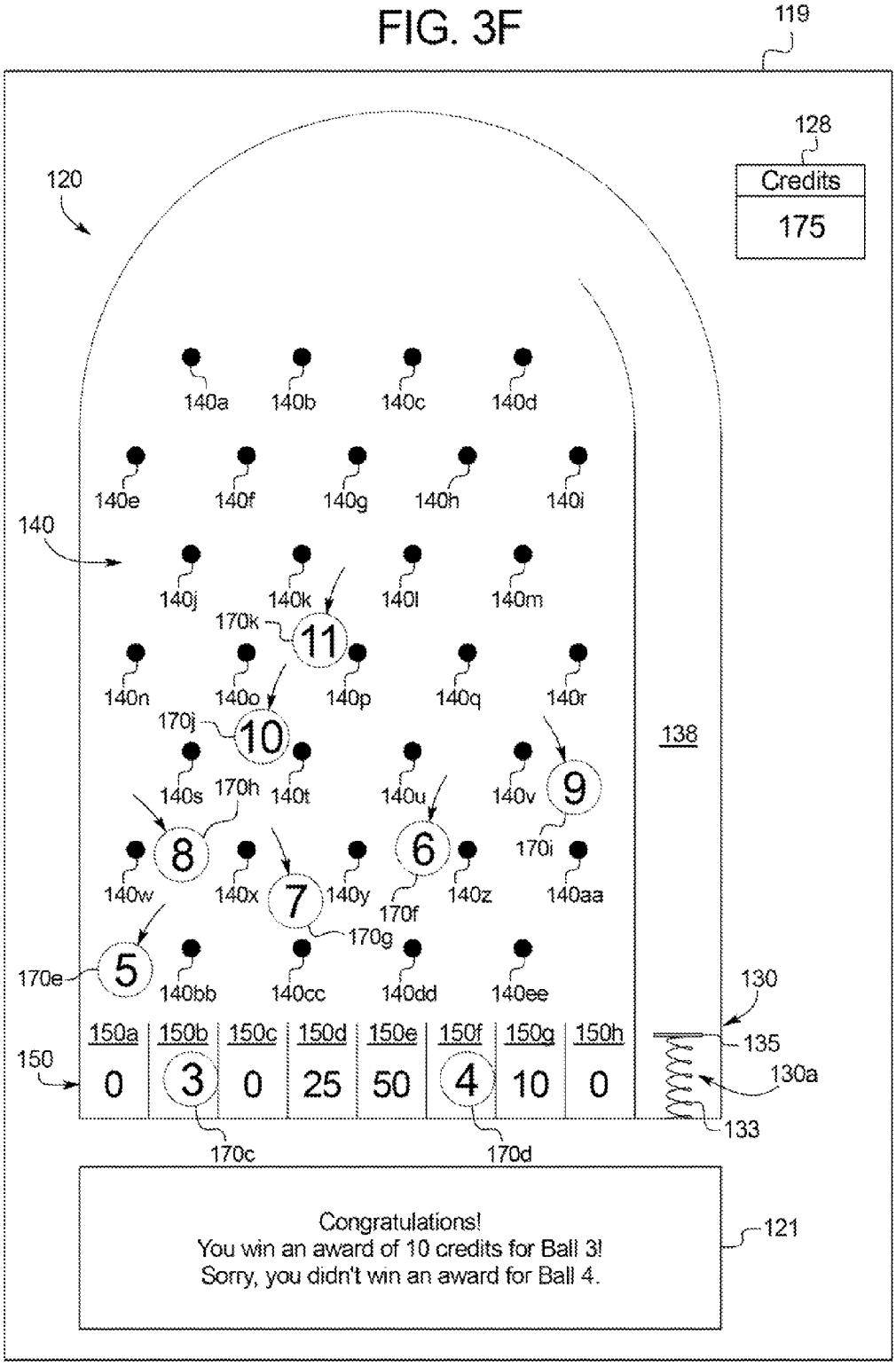

Accordingly, as illustrated in FIG. 3F, object ending position 150*a* is associated with a winnable award of 0 credits, object ending position 150*b* is associated with a winnable award of 10 credits, object ending position 150*c* is associated with a winnable award of 0 credits, object ending position 150*d* is associated with a winnable award of 25 credits, object ending position 150*e* is associated with a winnable award of 50 credits, object ending position 150*f* is associated with an award of 0 credits, object ending position 150*g* is associated with a winnable award of 10 credits, and object ending position 150*h* is associated with a winnable award of 0 credits. As shown in FIG. 3F, object 170*c* falls into object ending position 150*b*. The gaming system provides the player with the winnable award of 10 credits associated with object ending area 150*b* and increases the player's credit balance from 165 to 175 credits, as shown in credit meter 128. The third play of the obstacle board game is, therefore, complete. Additionally, object 170*d* falls into object ending position 150*f*. The gaming system does not provide the player with any winnable award because the award associated with object ending position 150*f* is an award of 0 credits. The fourth play of the obstacle board game is, therefore, complete.

It should be appreciated that rather than returning any changed winnable awards back to their original values after the quantity of concurrently pending plays of the game falls below the designated quantity of plays, in some embodiments the gaming system changes one or more of the changed winnable awards in a different manner. For example, in certain embodiments the gaming system changes one or more of the changed winnable awards by decreasing the changed winnable awards by a designated amount such that those changed winnable awards still have values greater than their original values. In certain other embodiments the gaming system changes a plurality of the changed winnable awards by returning those changed winnable awards to their original values but does not change certain other changed winnable awards.

It should thus be appreciated that in the example embodiment described above with respect to FIGS. 3A, 38, 3C, 3D, 3E, and 3F, and in certain other embodiments, once the quantity of concurrently pending plays of the game falls below the designated quantity of plays of the game, the gaming system returns any changed winnable awards of any pending plays of the game back to their pre-change state. That is, in these embodiments, the quantity of concurrently pending plays of the game must be greater than or equal to (or greater than, in some embodiments) the designated quantity of plays of the game for the changed winnable awards to remain changed.

In certain other embodiments, however, once the gaming system changes one or more winnable awards included in a play of a game when the quantity of concurrently pending plays of the game equals or exceeds (or exceeds in some embodiments) the designated quantity of plays of the game, the gaming system does not return those changed winnable awards of that play of the game to their original values. That is, those changed winnable awards of that play of the game remain changed even when the quantity of concurrently pending plays of the game falls below the designated quantity of plays of the game.

FIGS. 4A, 4B, 4C, and 4D illustrate an example of one of these embodiments of the gaming system and gaming device of the present disclosure. In this embodiment, the gaming system is configured to operate a slot game. The gaming system includes a display device 219 that displays the slot game including a plurality of reels 230*a*, 230*b*, and 230*c*, each of which includes a plurality of symbols, and a plurality of symbol display areas 231*a*, 231*b*, 231*c*, 231*d*, 231*e*, 231*f*, 231*g*, 231*h*, and 231*i*. Reel 230*a* displays symbols at symbol display areas 231*a*, 231*d*, and 231*g*; reel 230*b* displays symbols at symbol display areas 231*b*, 231*e*, and 231*h*; and reel 230*c* displays symbols at symbol display areas 231*c*, 231*f*, and 231*i*.

Display device 219 displays a payline that is associated with a plurality of the symbol display areas. Specifically, payline A 232*a* is associated with symbol display areas 231*d*, 231*e*, and 231*f*. For clarity and brevity, payline A 132*a* is sometimes referred to herein as payline A. Display device 219 displays a paytable 222 for the slot game that includes a plurality of winning symbol combinations. Paytable 222 indicates the winnable award amount associated with each respective winning symbol combination. More specifically, winning symbol combination SEVEN-SEVEN-SEVEN is associated with a winnable award of 1,000 credits; winning symbol combination DOLLAR SIGN-DOLLAR SIGN-DOLLAR SIGN is associated with a winnable award of 500 credits: winning symbol combination BAR-BAR-BAR is associated with a winnable award of 50 credits; and winning symbol combination CHERRY-CHERRY-CHERRY is associated with a winnable award of 10 credits.

It should be appreciated that the display device may display any suitable quantity of reels including any suitable quantity of corresponding symbol display areas in any suitable configuration or arrangement, it should also be appreciated that the display device may display any suitable quantity of paylines for the wagering game. It should further be appreciated that each of the displayed paylines may be associated with any suitable quantity of the symbol display areas and any suitable combination of the symbol display areas. It should be appreciated that any other suitable award determination other than a payline evaluation may be used, such as a ways to win and/or a scatter pay award determination (described in detail above). It should be appreciated that the paytable may be modified to reflect lower credit payouts when a wager that is less than the maximum wager is placed by the player for the wagering game. It should also be appreciated that any suitable paytable including any suitable quantity of winning symbol combinations may be employed, that any suitable combination of the symbols may be used as a winning symbol combinations, and that the winning symbol combinations may be associated with any suitable winnable awards. It should also be appreciated that any suitable quantity of paytables may be utilized. It should further be appreciated that any suitable symbols may be employed. The symbols may include, for example, any suitable markings or indicia such as letters, numbers, or illustrations or pictures of objects.

Figure 4A:
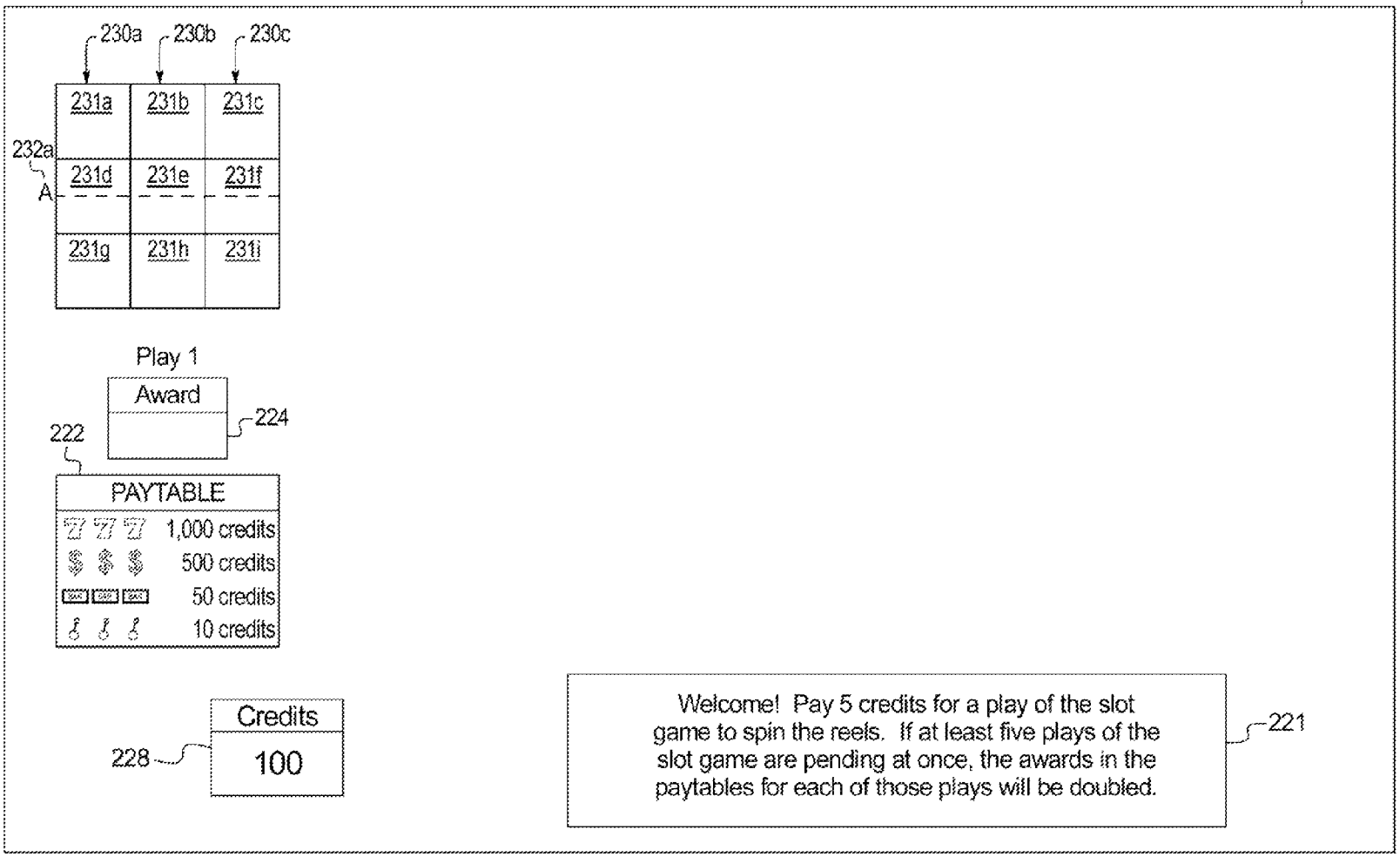

As shown in FIG. 4A, when the gaming system is not being played by a player, display device 219 displays a welcome or attract screen that includes a welcome message in indication box 221. The welcome message provides an invitation to pay five credits to initiate a play of the slot game and spin reels 230*a*, 230*b*, and 230*c*. In this example, each spin of each set of reels represents a different play of the slot game. After a player initiates a play of the slot game, the gaming system enables the player to initiate a subsequent play of the slot game prior to completion of that previous play of the slot game. In other words, the gaming system enables the player to spin another set of reels before the previously-spun set of reels stops spinning. It should be appreciated that since an appreciable period of time (for example, two to three seconds) elapses between the initiation and the completion of a play of the slot game (i.e. between the time the reels begin spinning and the time the reels stop spinning), multiple plays of the slot game may be concurrently pending. That is, if the player sequentially initiates a plurality of plays of the slot game (i.e., spins a plurality of sets of reels) quickly enough, those plays will be pending at the same time.

In this embodiment, when at least a designated quantity of plays of the slot game are concurrently pending, the gaming system changes the winnable awards in the paytable associated with each of the concurrently pending plays of the slot game. In this embodiment, the designated quantity of plays is five plays, and the gaming system changes the winnable awards by doubling the winnable awards. The welcome message provides a notification that when at least five plays of the slot game have been initiated but are not complete, the gaming system will double the winnable awards in the paytables for those concurrently pending plays of the slot game. It should thus be appreciated that players are incentivized to concurrently play a relatively high quantity of plays of the slot game in order to increase the winnable awards associated with those plays of the slot game.

Figure 4B:
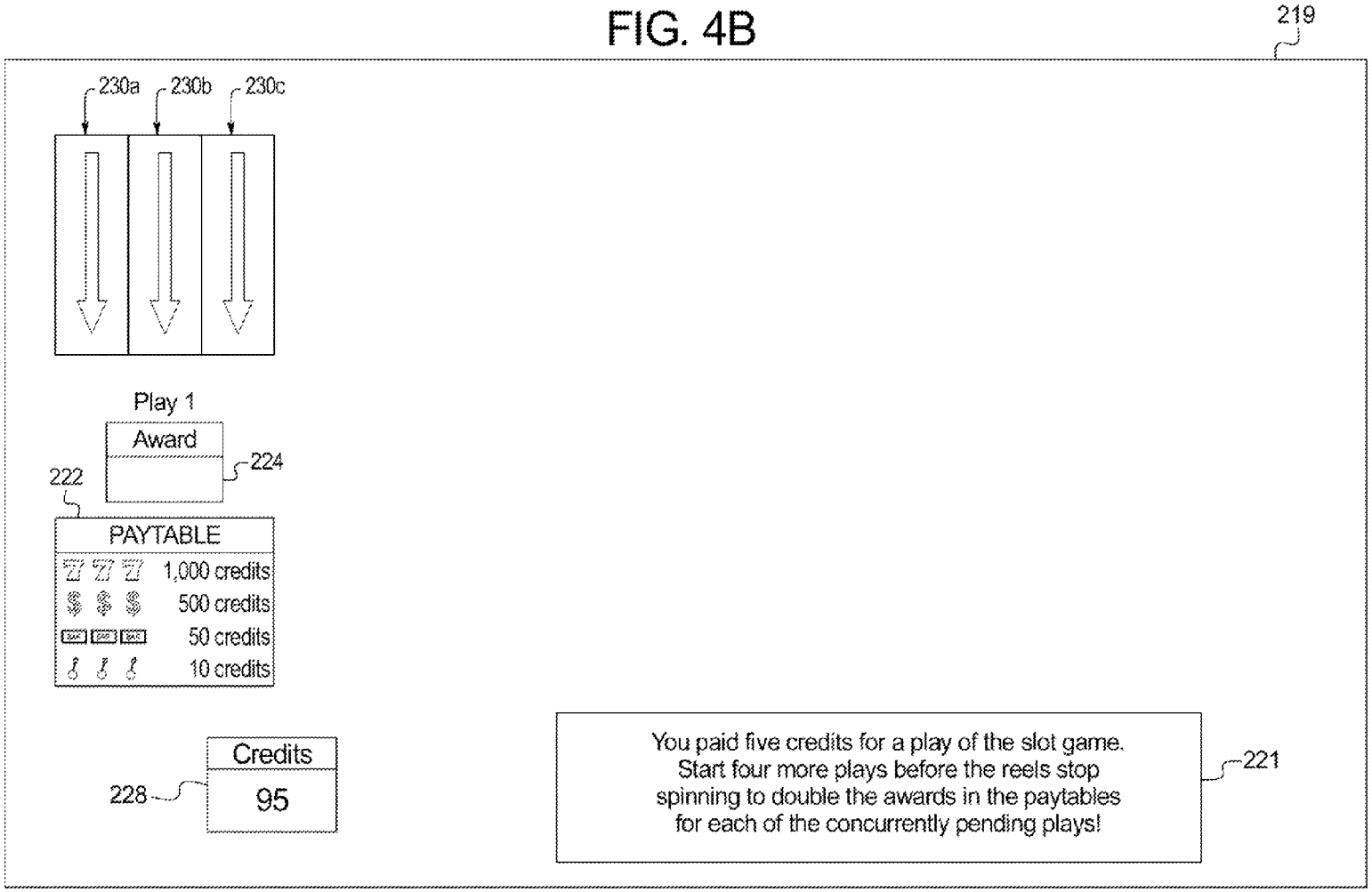

As illustrated in FIG. 4B, the player initiates a first play of the slot game. Upon initiation of the first play of the slot game, the gaming system decreases the player's credit balance from 100 credits to 95 credits to reflect the 5 credit cost of that play of the slot game, as shown in credit meter 228, and displays reels 230*a*, 230*b*, and 230*c* spinning. Since one play of the slot game is currently pending, indication box 221 displays a message to the player including a notification that if four or more plays of the slot game are initiated but not completed before the spinning reels of the first play of the slot game stop, the gaming system will double the winnable awards in the paytable associated with those plays of the slot game and the first play of the slot game.

Figure 4C:
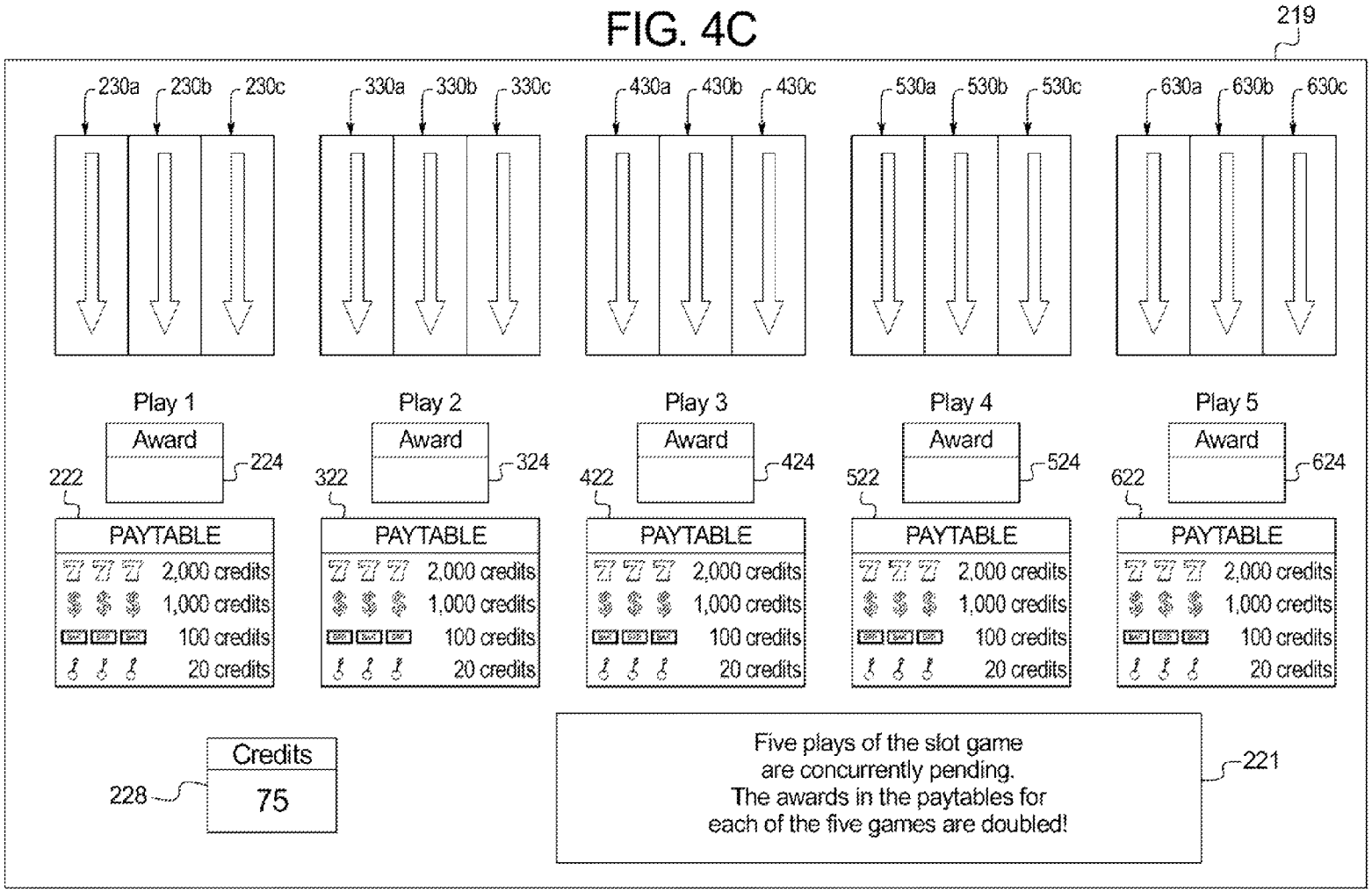

As illustrated in FIG. 4C, prior to completion of the first play of the slot game (i.e., before the spinning reels of the first play of the slot game stop spinning), the player initiated but did not complete four additional plays of the slot game. Upon initiation of each of the additional plays, the gaming system reduced the player's credit balance by 5 credits to reflect the 5 credit cost of that play of the slot game and displayed reels 330*a*, 330*b*, and 330*c* spinning (second play); reels 430*a*, 430*b*, and 430*c* spinning (third play); reels 530*a*, 530*b*, and 530*c* spinning (fourth play); and reels 630*a*, 630*b*, and 630*c* spinning (fifth play). Accordingly, the player's credit balance decreased from 95 to 75 credits, as shown in credit meter 228, and five sets of reels are concurrently spinning. Put differently, five plays of the slot game are concurrently pending (i.e., initiated but not completed).

Since at least five plays of the slot game are concurrently pending, the gaming system automatically doubles the winnable awards in the paytables of each of the concurrently pending plays of the slot game. Specifically, as illustrated in FIG. 4C, each of the winnable awards in each of paytables 222, 322, 422, 522, and 622 are doubled. As explained above, in this embodiment, after the gaming system changes the winnable awards they remain changed regardless of the quantity of concurrently pending plays of the slot game. In other words, even if the quantity of concurrently pending plays of the slot game falls below the designated quantity of plays of the slot game, the changed winnable awards in the paytables associated with any pending plays of the slot game remain changed.

Figure 4D:
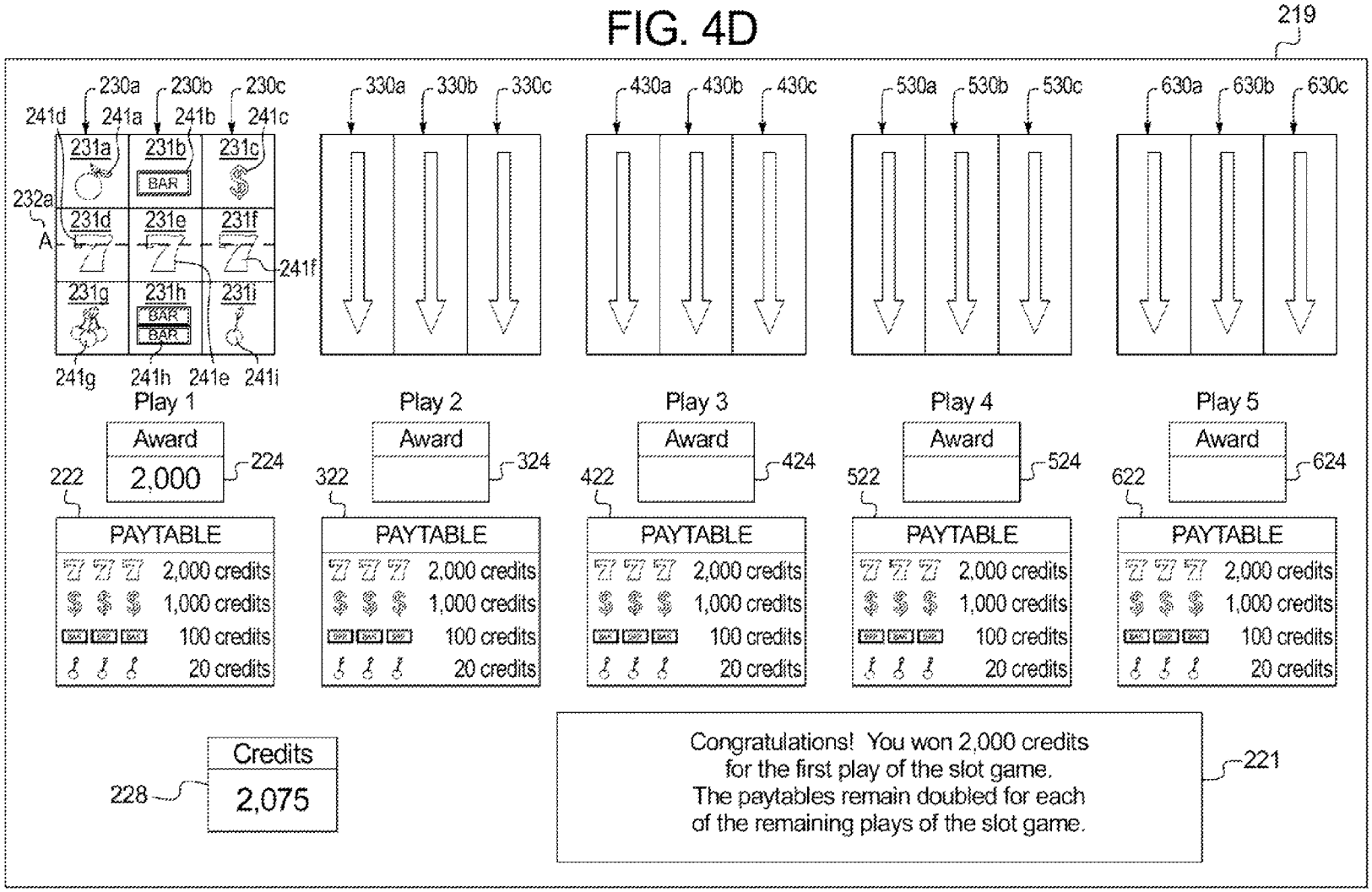

As illustrated in FIG. 4D, the reels for the first play of the slot game (i.e., reels 230*a*, 230*b*, and 230*c* stop spinning such that symbols 241*a*, 241*b*, 241*c*, 241*d*, 241*e*, 241*f*, 241*g*, 241*h*, and 241*i* at symbol display areas 231*a*, 231*b*, 231*c*, 231*d*, 231*e*, 231*f*, 231*g*, 231*h*, and 231*i*, respectively. A winning symbol combination is displayed along payline A. Specifically, symbol display areas 231*d*, 231*e*, and 231*f* along payline A each display SEVEN symbols 241*d*, 241*e*, and 241*f*, respectively. As indicated in paytable 222, the player wins the changed winnable award of 2,000 credits for the displayed SEVEN-SEVEN-SEVEN winning symbol combination, and the award is displayed in award indicator 224. The player's credit balance displayed in credit meter 228 increases to 2,075 credits, which reflects the player's credit balance of 75 credits plus the player's award of 2,000 credits. The first play of the slot game is, therefore, complete.

Now that the first play of the slot game is complete, four plays (i.e., the second through fifth plays) of the slot game are concurrently pending. Thus, at this point the quantity of concurrently pending plays of the slot game (four) is less than the designated quantity of plays of the slot game (five). However, as explained above, in this embodiment the gaming system does not change any changed winnable awards back to their original states when the quantity of concurrently pending plays of the slot game falls below the designated quantity of plays of the slot game. Therefore, as shown in FIG. 4D, the changed winnable awards of paytables 322, 422, 522, and 622 associated with the second, third, fourth, and fifth plays of the slot game, respectively, remain changed.

It should be appreciated, however, that for any additional plays of the slot game that are initiated subsequent to the fifth play of the slot game, those plays will each include paytables having unchanged winnable awards unless, upon initiation, at least five plays of the slot game are concurrently pending. For example, if the first, second, and third plays of the slot game are complete; the fourth and fifth plays of the slot game are concurrently pending; and the player initiates a sixth play of the slot game, the winnable awards associated with the sixth play of the slot game are unchanged winnable awards. In this example, upon initiation of the sixth play of the slot game, only three plays of the slot game were concurrently pending (the fourth, fifth, and sixth plays). Therefore, in this example the sixth play of the slot game will include unchanged winnable awards unless the player initiates more plays of the slot game such that at least five plays of the slot game (including the sixth play) are concurrently pending.

It should be appreciated that the gaming system may change one, a plurality, or all of the winnable awards associated with a play of a game when the quantity of concurrently pending plays of the game equals or exceeds (or, in some embodiments, exceeds) the designated quantity of plays of the game. In some embodiments, the quantity of winnable awards associated with a play or plays of the game that are changed is based on the relative difference between the quantity of concurrently pending plays of the game and the designated quantity of plays of the game. For example, in one embodiment the designated quantity of plays of the game is five, and each play of the game is associated with ten winnable awards. In this example, when the quantity of concurrently pending plays of the game equals the designated quantity of plays of the game, the gaming system changes one winnable award associated with each concurrently pending play of the game. In this example, for each additional play of the game initiated prior to the completion of the concurrently pending plays of the game, the gaming system changes another one of the winnable awards associated with each play of the game. For example, if six plays of the game are concurrently pending, the gaming system changes two winnable awards of each of the six concurrently pending plays of the game, and if ten plays of the game are concurrently pending, the gaming system changes six winnable awards of each of the ten concurrently pending plays of the game.

In other embodiments, the quantity of concurrently pending plays of the game having one or more winnable awards changed by the gaming system is based on the relative difference between the quantity of concurrently pending plays of the game and the designated quantity of plays of the game. For example, in one embodiment the designated quantity of plays of the game is five. In this example, when the quantity of concurrently pending plays of the game equals the designated quantity of plays of the game, the gaming system changes winnable awards associated with one of the concurrently pending plays of the game. In this example, for each additional play of the game initiated prior to the completion of the concurrently pending plays of the game, the gaming system changes the winnable awards of another one of the concurrently pending plays of the game. For example, if six plays of the game are concurrently pending, the gaming system changes the winnable awards associated with two of the six concurrently pending plays of the game, and if ten plays of the game are concurrently pending, the gaming system changes the winnable awards associated with six of the ten concurrently pending plays of the game. It should be appreciated that, in certain embodiments, the gaming system determines to change the winnable awards of the plays of the game based on the order in which the plays of the game were initiated. For example, the gaming system changes the winnable awards of the earliest initiated play of the game first, and the gaming system changes the winnable awards of the latest initiated play of the game last.

In the above described embodiments, when the quantity of concurrently-pending plays of a game is greater than the designated quantity of plays of the game, the gaming system changes one or more of the winnable awards associated with one or more of the concurrently pending plays of the game. However, it should be appreciated that that in various other embodiments, rather than or in addition to changing one or more of the winnable awards of one or more of the concurrently pending plays of the game, the gaming system: (a) provides a bonus award, such as a predetermined, randomly determined, or progressive bonus award, to the player; (b) provides a secondary or bonus event, such as a secondary or bonus game, to the player; (c) provides a secondary or bonus game mode for the game to the player; and/or (d) unlocks one or more extra or bonus features for the game.

While each of the above embodiments were described with respect to a single game (i.e., the obstacle board game or the slot game), it should be appreciated that, in certain embodiments, the gaming system enables a player to concurrently play a plurality of plays of a plurality of games. In these embodiments, when a quantity of concurrently pending plays of the games is greater than or equal to a designated quantity of plays of the games, the gaming system changes the winnable award or awards of one or more of those concurrently pending plays of the games that may be provided to the player for those one or more concurrently pending plays of the games. In certain of these embodiments, those changed winnable awards remain changed as long as the quantity of concurrently pending plays of the games is greater than or equal to the designated quantity of plays of the games. Thereafter, if the quantity of concurrently pending plays of the games falls below the designated quantity of plays of the games, the gaming system returns any changed winnable awards of any pending plays of the games to their original winnable award states. In certain other of these embodiments, those changed winnable awards remain changed regardless of whether the quantity of concurrently pending plays of the games falls below the designated quantity of plays of the games.

In certain embodiments, the gaming system enables a plurality of players to simultaneously play a game in a community or multi-player manner. In some of these embodiments the gaming system includes a plurality of gaming devices each played by one of the players. In certain embodiments, the gaming system includes a shared display device configured to display the game. In certain other embodiments, the game is displayed on the display device of the gaming device played by each of the players. In one of these embodiments, the players compete against one another to achieve the highest number of concurrently pending plays of the game within a predetermined time period. For example, if the game is the obstacle board game described above, and the predetermined time period is fifteen seconds, the players compete against one another to achieve the most objects in the obstacle display area at the same time during those fifteen seconds. Upon the expiration of the predetermined time period, the gaming system ranks the players based upon the highest quantity of concurrently pending plays of the game the player achieved, and provides one or more of the players with an award and/or triggers a bonus or secondary game for one or more players based upon the ranking.

It should be appreciated that the above-described game may be employed for teams of players rather than individual players. In these embodiments, the teams compete against one another in a manner similar to the one described above to achieve the highest number of concurrently pending plays of the game within a predetermined time period. Upon expiration of the predetermined time period, the gaming system ranks the teams based upon the highest quantity of concurrently pending plays of the game the team achieved, and provides the players of one or more teams awards or bonus events accordingly.

It should be appreciated that the present disclosure may be implemented with respect to a plurality of concurrently pending events that occur during a play of a game rather than with respect to a plurality of concurrently pending plays of a game. More specifically, in some embodiments, when a quantity of concurrently pending random events of a play of a game is greater than or equal to a designated quantity of random events, the gaming system changes one or more winnable awards associated with one or more of those concurrently pending random events. In certain embodiments, those changed winnable awards remain changed as long as the quantity of concurrently pending random events is greater than or equal to the designated quantity of random events. In these embodiments, after the gaming system changes any winnable awards, if the quantity of concurrently pending random events falls below the designated quantity of random events, the gaming system returns any changed winnable awards of any pending random events to their original winnable award states. In certain other embodiments, those changed winnable awards remain changed regardless of whether the quantity of concurrently pending random events falls below the designated quantity of random events.

In certain embodiments, alternatively or in addition to changing winnable awards associated with concurrently pending plays of a game, the gaming system changes awards provided to players for completed plays of the game. Thus, in these embodiments, when the quantity of concurrently pending plays of the game is greater than or equal to the designated quantity of plays of the game, the gaming system changes one or more awards already provided to the player for initiated and completed (i.e., non-pending) plays of the game.

In certain embodiments, rather than determining whether to change one or more winnable awards associated with one or more pending plays of the game based on comparing the quantity of concurrently pending plays of the game with the designated quantity of plays of the game, the gaming system determines whether to change one or more winnable awards associated with one or more plays of the game based on a rate of play of the game. In this embodiment, if the player's rate of play of the game is greater than or equal to (or, in some embodiments, greater than) a designated rate of play, the gaming system changes one or more winnable awards associated with one or more pending plays of the game.

In certain embodiments, the gaming system includes a plurality of tiers of changes that may be applied to the winnable awards based on the quantity of concurrently pending plays of the game. In some embodiments, the higher the quantity of concurrently pending plays of the game, the more advantageous the changes to the winnable awards. For example, in one embodiment a first change (such as a 2× multiplier) is applied to the winnable awards when ten plays of the game are concurrently pending, and a second, more advantageous change (such as a 5× multiplier) is applied to those changed winnable awards when twenty plays of the game are concurrently pending. In these embodiments, the player has incentive to sequentially initiate a high number of plays of the game in order to potentially win large awards.

It should be understood that various changes and modifications to the presently preferred embodiments described herein will be apparent to those skilled in the art. Such changes and modifications may be made without departing from the spirit and scope of the present invention and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device that stores a plurality of instructions which, when executed by the at least one processor, cause the at least one processor to operate with the at least one display device and the at least one input device to:

(a) enable a player to sequentially initiate a plurality of random events, each of the random events including one or more awards available to be won in said random event;

(b) monitor a quantity of any initiated random events that are concurrently pending; and (c) if the monitored quantity of concurrently pending random events reaches a designated quantity, provide a designated award regardless of outcomes of said concurrently pending random events.

2. The gaming system of claim 1, wherein each random event includes a play of a game.

3. The gaming system of claim 1, wherein the plurality of instructions, when executed by the at least one processor, cause the at least one processor to, if the monitored quantity of concurrently pending random events reaches the designated quantity, in addition to providing the designated award, for at least one of the concurrently pending random events, change one or more of the awards available to be won in said at least one random event.

4. The gaming system of claim 3, wherein the plurality of instructions, when executed by the at least one processor, cause the at least one processor to, if the monitored quantity of concurrently pending random events reaches the designated quantity, for at least one of the concurrently pending random events, change one or more of the awards available to be won in said at least one random event by increasing an initial amount of said one or more awards available to be won.

5. The gaming system of claim 4, wherein the plurality of instructions, when executed by the at least one processor, cause the at least one processor to, if the monitored quantity of concurrently pending random events falls below the designated quantity, change at least one changed award available to be won in said at least one random event by returning the amount of said at least one award available to be won to the initial amount of said at least one award available to be won.

6. The gaming system of claim 4, wherein the plurality of instructions, when executed by the at least one processor, cause the at least one processor to, if the monitored quantity of concurrently pending random events falls below the designated quantity, change at least one changed award available to be won in said at least one random event by decreasing an amount of said at least one award available to be won.

7. A method of operating a gaming system, said method comprising:

(a) enabling a player to sequentially initiate a plurality of random events, each of the random events including one or more awards available to be won in said random event;

(b) causing at least one processor to execute a plurality of instructions stored in at least one memory device to monitor a quantity of any initiated random events that are concurrently pending; and (c) if the monitored quantity of concurrently pending random events reaches a designated quantity, providing a designated award regardless of outcomes of said concurrently pending random events.

8. The method of claim 7, wherein each random event includes a play of a game.

9. The method of claim 7, which includes, if the monitored quantity of concurrently pending random events reaches the designated quantity, in addition to providing the designated award, causing the at least one processor to execute the plurality of instructions to, for at least one of the concurrently pending random events, change one or more of the awards available to be won in said at least one random event.

10. The method of claim 9, which includes causing the at least one processor to execute the plurality of instructions to, if the monitored quantity of concurrently pending random events reaches the designated quantity, for at least one of the concurrently pending random events, change one or more of the awards available to be won in said at least one random event by increasing an initial amount of said one or more awards available to be won.

11. The method of claim 10, which includes causing the at least one processor to execute the plurality of instructions to, if the monitored quantity of concurrently pending random events falls below the designated quantity, change at least one changed award available to be won in said at least one random event by returning the amount of said at least one award available to be won to the initial amount of said at least one award available to be won.

12. The method of claim 10, which includes causing the at least one processor to execute the plurality of instructions to, if the monitored quantity of concurrently pending random events falls below the designated quantity, change at least one changed award available to be won in said at least one random event by decreasing an amount of said at least one award available to be won.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

(a) enable a player to sequentially initiate a plurality of random events, each of the random events including one or more awards available to be won in said random event;

(b) monitor a quantity of any initiated random events that are concurrently pending; and (c) if the monitored quantity of concurrently pending random events reaches a designated quantity, provide a designatedaward regardless of outcomes of said concurrently pending random events.

16. The non-transitory computer readable medium of claim 15, wherein each random event includes a play of a game.

17. The non-transitory computer readable medium of claim 15, wherein the plurality of instructions, when executed by the at least one processor, cause the at least one processor to, if the monitored quantity of concurrently pending random events reaches the designated quantity, in addition to providing the designated award, for at least one of the concurrently pending random events, change one or more of the awards available to be won in said at least one random event.

18. The non-transitory computer readable medium of claim 17, wherein the plurality of instructions, when executed by the at least one processor, cause the at least one processor to, if the monitored quantity of concurrently pending random events reaches the designated quantity, for at least one of the concurrently pending random events, change one or more of the awards available to be won in said at least one random event by increasing an initial amount of said one or more awards available to be won.

19. The non-transitory computer readable medium of claim 18, wherein the plurality of instructions, when executed by the at least one processor, cause the at least one processor to, if the monitored quantity of concurrently pending random events falls below the designated quantity, change at least one changed award available to be won in said at least one random event by returning the amount of said at least one award available to be won to the initial amount of said at least one award available to be won.

20. The non-transitory computer readable medium of claim 18, wherein the plurality of instructions, when executed by the at least one processor, cause the at least one processor to, if the monitored quantity of concurrently pending random events falls below the designated quantity, change at least one changed award available to be won in said at least one random event by decreasing an amount of said at least one award available to be won.

* * * * *

UNITED STATES PATENT AND TRADEMARK OFFICE

CERTIFICATE OF CORRECTION

PATENT NO. : 8,911,290 B2
APPLICATION NO. : 14/024279
DATED : December 16, 2014
INVENTOR(S) : William R. Brosnan et al.

It is certified that error appears in the above-identified patent and that said Letters Patent is hereby corrected as shown below:

IN THE CLAIMS

In Claim 3, Column 33, Line 66, between “the” and “awards” insert --one or more--.
In Claim 4, Column 33, Line 6, between “the” and “awards” insert --one or more--.
In Claim 5, Column 33, Line 14, replace “the” with --an--.
In Claim 9, Column 33, Line 46, between “the” and “awards” insert --one or more--.
In Claim 10, Column 33, Line 53, between “the” and “awards” insert --one or more--.
In Claim 11, Column 33, Line 61, replace “the” with --an--.
In Claim 15, Column 35, Line 20, replace “designatedaward” with --designated award--.
In Claim 17, Column 36, Line 1, between “the” and “awards” insert --one or more--.
In Claim 18, Column 36, Line 9, between “the” and “awards” insert --one or more--.
In Claim 19, Column 36, Line 17, replace “the” with --an--.

Signed and Sealed this
Twenty-sixth Day of May, 2015

Michelle K. Lee

Michelle K. Lee
*Director of the United States Patent and Trademark Office*